US012778275B2

(12) United States Patent
Fischer et al.

(10) Patent No.: US 12,778,275 B2
(45) Date of Patent: Nov. 3, 2026

(54) APPLICATOR DEVICE

(71) Applicants: TRISA HOLDING AG, Triengen (CH); GEKA GmbH, Bechhofen (DE)

(72) Inventors: Herbert Fischer, Reitnau (CH); Oscar Trevisan, Oftringen (CH); Erika Von Jan, Roth (DE)

(73) Assignees: TRISA HOLDING AG, Triengen (CH); GEKA GMBH, Bechhofen (DE)

( * ) Notice: Subject to any disclaimer, the term of this patent is extended or adjusted under 35 U.S.C. 154(b) by 557 days.

(21) Appl. No.: 17/618,810

(22) PCT Filed: Jun. 10, 2020

(86) PCT No.: PCT/EP2020/066095
§ 371 (c)(1),
(2) Date: Dec. 13, 2021

(87) PCT Pub. No.: WO2020/249618
PCT Pub. Date: Dec. 17, 2020

(65) Prior Publication Data

US 2022/0232962 A1 Jul. 28, 2022

(30) Foreign Application Priority Data

Jun. 13, 2019 (EP) ..... 19180090

(51) Int. Cl.
*A46B 9/02* (2006.01)
*A46B 3/00* (2006.01)
(Continued)

(52) U.S. Cl.
CPC ..... *A46B 9/021* (2013.01); *A46B 3/005* (2013.01); *A46B 3/08* (2013.01); *A46B 7/042* (2013.01);
(Continued)

(58) Field of Classification Search
CPC .... A46B 9/02; A46B 3/00; A46B 7/04; A46B 3/08; A46B 9/06; A46B 9/021;
(Continued)

(56) References Cited

U.S. PATENT DOCUMENTS 2,652,580 A 9/1953 Neugass
6,003,188 A * 12/1999 Henry ..... A46B 5/02 15/176.1
(Continued)

FOREIGN PATENT DOCUMENTS

DE 20 2016 007 489 U1 12/2016
EP 0 972 465 A1 1/2000
(Continued)

OTHER PUBLICATIONS

Jan. 20, 2021 Search Report issued in International Patent Application No. PCT/EP2020/066095.
(Continued)

*Primary Examiner* — Monica S Carter
*Assistant Examiner* — Kent N Shum
(74) *Attorney, Agent, or Firm* — Oliff PLC

(57) ABSTRACT

An applicator device for cosmetic and/or hygiene applications, which includes a shaft with a longitudinal axis, a proximal and a distal end as well as a carrier element, wherein at the carrier element there are arranged bristle elements in an anchor-free manner, wherein the carrier element is introduced in a receiving opening or put onto a receiving section at the distal end of the shaft and wherein the carrier element is connected to the shaft and to a respective method.

24 Claims, 19 Drawing Sheets

(51) Int. Cl.

| | |
|---|---|
| ***A46B 3/08*** | (2006.01) |
| ***A46B 7/04*** | (2006.01) |
| ***A46B 9/06*** | (2006.01) |
| ***A46D 1/00*** | (2006.01) |

(52) U.S. Cl.
CPC ..... *A46B 7/044* (2013.01); *A46B 9/06* (2013.01); *A46D 1/0207* (2013.01); *A46B 2200/1046* (2013.01)

(58) Field of Classification Search
CPC . A46B 3/005; A46B 7/042; A46B 2200/1046; A46B 7/044; A46D 1/00; A46D 1/0207
See application file for complete search history.

(56) References Cited

U.S. PATENT DOCUMENTS

| | | | | |
|---|---|---|---|---|
| 6,073,634 | A | 6/2000 | Gueret | |
| 6,220,672 | B1 | 4/2001 | Weihrauch | |
| 7,174,596 | B2 | 2/2007 | Fischer et al. | |
| 8,534,769 | B2 | 9/2013 | Loetscher et al. | |
| 8,578,563 | B2 * | 11/2013 | Bagley | B05C 17/0205 16/422 |
| 9,066,579 | B2 | 6/2015 | Hess et al. | |
| 10,021,960 | B1 | 7/2018 | Douglas et al. | |
| 10,610,340 | B2 | 4/2020 | Fischer et al. | |
| 11,219,303 | B2 | 1/2022 | Strahler et al. | |
| 2005/0086753 | A1 | 4/2005 | Roberts et al. | |
| 2005/0196220 | A1 * | 9/2005 | Gueret | A46B 11/001 15/207.2 |
| 2006/0090277 | A1 | 5/2006 | Petit | |
| 2006/0150355 | A1 | 7/2006 | Mason et al. | |
| 2009/0038094 | A1 | 2/2009 | Kim | |
| 2010/0139677 | A1 * | 6/2010 | Tsai | A45D 29/12 401/172 |
| 2010/0287718 | A1 * | 11/2010 | Kim | A46B 9/021 15/207.2 |
| 2011/0061188 | A1 * | 3/2011 | Monteith | A46B 3/00 15/145 |
| 2012/0227201 | A1 * | 9/2012 | Brown, Jr. | A61C 17/222 15/167.1 |
| 2013/0121752 | A1 * | 5/2013 | Byun | A46B 7/023 401/269 |
| 2014/0332027 | A1 | 11/2014 | Lim | |
| 2017/0196349 | A1 * | 7/2017 | Adorno | B25G 1/04 |
| 2019/0175320 | A1 * | 6/2019 | Bloch | A46B 5/0095 |
| 2020/0093247 | A1 * | 3/2020 | Gunness | A46B 7/042 |
| 2020/0315758 | A1 * | 10/2020 | Papazian | A46B 7/04 |
| 2020/0397131 | A1 * | 12/2020 | Maurin | A45D 33/00 |
| 2021/0368973 | A1 * | 12/2021 | Sprosta | A46B 7/042 |

FOREIGN PATENT DOCUMENTS

| | | | |
|---|---|---|---|
| EP | 1 894 489 | A2 | 3/2008 |
| EP | 2 000 044 | A2 | 12/2008 |
| EP | 1 423 027 | B1 | 9/2009 |
| EP | 2 218 352 | A1 | 8/2010 |
| KR | 10-0571855 | B1 | 3/2006 |
| KR | 10-0768937 | B1 | 10/2007 |
| KR | 200446473 | Y1 * | 11/2009 |
| WO | 2009/127280 | A2 | 10/2009 |
| WO | 2011/072865 | A1 | 6/2011 |
| WO | 2015/200774 | A1 | 12/2015 |
| WO | 2015/200775 | A2 | 12/2015 |
| WO | 2015/200776 | A1 | 12/2015 |
| WO | 2016/102221 | A1 | 6/2016 |
| WO | 2017/182355 | A1 | 10/2017 |
| WO | 2018/164622 | A1 | 9/2018 |

OTHER PUBLICATIONS

Jan. 20, 2021 Written Opinion issued in International Patent Application No. PCT/EP2020/066095.
Dec. 14, 2021 International Preliminary Report on Patentability issued in International Patent Application No. PCT/EP2020/066095.
Jan. 20, 2025 European Communication issued in European Application No. 20731476.6.
Oct. 10, 2024 Office Action issued in European Application No. 19 180 090.3.

* cited by examiner

APPLICATOR DEVICE

The present invention relates to an applicator device which may be used in particular for cosmetic and/or hygiene applications. Such an applicator device may for example be in the form of a nail, lip, eye, eyelash, eyebrow, make-up, hair care, hair coloring or a healthcare product applicator.

A known personal-care applicator is described in WO 2015/200776 A1. This applicator comprises at least one stem having a longitudinal axis, a proximal end including a handle, and a distal end opposite to the proximal end, and at least a first plurality of bristle elements ultrasonically welded to the stem and outwardly extending therefrom according to a first pre-determined pattern, wherein the elongated stem and the at least first plurality of bristle elements comprise ultrasonically compatible materials, and wherein the bristles are ultrasonically bonded to the stem through a direct ultrasonic bond between a surface of the stem and a lengthwise portion of each of the bristle elements.

In US 2009/0038094 A1 a make-up brush is described which includes a coating section for applying liquid cosmetic on a predetermined surface, the coating section having a plurality of bristle elements which forms a bristle bundle, while being spaced at a predetermined distance from each other; a heat-bonded portion formed by melting one end of the bristle elements such that the ends are integrally connected to each other; a housing section having such a cross-sectional shape that the end of the coating section having the heat-bonded portion may be inserted and housed; a fixing section for fixing the end of the coating section, inserted into the housing section, such that the density of the bristle elements is uniform; and a rod section connected to the housing section and having such a length that a user can hold the rod section by hand.

A further applicator device is disclosed in US 2006/0090277 A1. The applicator includes a lower part for manually gripping the applicator, a central part for resiliently straining the applicator under a manual constraint, an upper part bearing an application material and an application material anchored to the upper part. The lower and central parts have mean visible cross-sections, denoted respectively SA and SB such that the relative deviation $ER1=|SA-SB|/SA$ is less than 0.1, the lower and central parts form a first longitudinal component having an axial direction and a first shape factor L/D between 3 and 7, L and D denoting respectively the largest axial length of and the largest diameter of the first component perpendicular to the axial direction.

WO 2009/127280 A2 relates to a paintbrush having a handle, a bristle support plate mounted directly on the handle, and a plurality of bristle bundles inserted through receiving openings in the bristle support plate.

EP 1 423 027 B1 discloses a method which is provided for manufacturing a function element carrier with function elements, for example, individual tufts made up of bristle elements and/or massage elements, interproximal cleaning elements, or other elements designed to be fastened to a toothbrush and also perform special functions. The function elements are equipped at their ends intended for anchoring in a toothbrush with an anchor, retainer or axle element. The method includes: inserting several function elements in corresponding recesses of an injection mold, said injection mold being connected via grid or bar shaped channels formed in a die to recesses in the areas of the anchoring ends of the function elements; filling the grid or bar shaped channels with liquefied plastic material and injecting said material at the anchoring ends of the function elements or embedding them therein; and allowing the plastic material to cool and removing a function element carrier made up of a grid or bar shaped plastic frame and the function elements. Function element carriers and toothbrushes are also provided.

WO 2017/182355 A1 relates to a brush product, in particular a toothbrush, having a base body with a head part with a front and a rear side, which comprises a bristle carrier with a longitudinal axis and a transverse axis and a bristle field protruding therefrom, wherein the bristle field is formed by at least one group of cleaning elements; a handle part; and a neck part connecting the head part and the handle part; wherein the bristle carrier is provided with bristle elements which are mounted without being anchored and wherein the bristle carrier comprises substantially a central support area, an upper support area, a lower support area, a right support area and a left support area, in which the groups of cleaning elements are arranged.

Still further applicators and brushes are described in US 2006/0150355 A1, U.S. Pat. No. 2,652,580, WO 2015/200775 A2, WO 2015/200774 A1, EP 2 000 044 A2, EP 1 894 489 A2 and EP 0 972 465 A1.

It is the object of the present invention to provide for a variable applicator device which is cost-effective to manufacture and a respective method.

This object is solved according to the present invention by means of an applicator device, in particular for cosmetic and/or hygiene applications, which comprises a shaft with a longitudinal axis, a proximal and a distal end as well as a carrier element, wherein at the carrier element there are bristle elements arranged in an anchor-free manner, wherein the carrier element is introduced in a receiving opening or put onto a receiving section at the distal end of the shaft and wherein the carrier element is connected to the shaft; and by means of a method for producing at least one applicator device, in particular for cosmetic and/or hygiene applications, which comprises a shaft and a carrier element with bristle elements, comprising at least the following steps: (a) injection molding of at least one shaft, wherein at a distal end of the at least one shaft a receiving opening or a receiving section for a carrier element is provided; (b) injection molding of at least one carrier element and simultaneously or subsequently providing the at least one carrier element with bristle elements in an anchor-free manner; and (c) mounting of the at least one bristle containing carrier element in the receiving opening or at the receiving section of the shaft.

In a preferred embodiment of the present invention, the carrier element is introduced in the receiving opening in such a way that it is flush with the upper edge at the distal end of the shaft when the carrier element and the shaft are assembled. In this manner, no protruding parts are created which could on the one hand lead to injuries during use and which on the other hand may hold back applicator medium.

In a further preferred embodiment of the present invention, at least one recess is provided in the upper edge at the distal end of the shaft. The at least one recess shall serve as a holding element for the protrusions (break-off edges or break-off webs) of the carrier element which result from the separation procedure, i.e. when the injection molded carrier elements forming the grid-like structure within the frame are separated into individual carrier elements by means of punching, cutting, etc. Alternatively, the grid-like structure and/or the individual carrier elements may be formed directly by means of punching, cutting a thermoplastic sheet.

In a further preferred embodiment of the present invention, the at least one recess in the upper edge at the distal end of the shaft serves for receiving lateral protrusions of the carrier element. Usually, the carrier elements comprise two lateral protrusions which are arranged on their narrow sides. However, it is also possible that the carrier elements within the grid-like structure are interconnected horizontally and vertically, so that two further webs are generated on the longitudinal sides of the carrier element. Thus, corresponding recesses may also be provided in the longitudinal sides. It is also conceivable that the carrier elements in the grid-like structure are interconnected in an x-like manner such that the protrusions are correspondingly arranged in the "corners" of the carrier elements.

In a further preferred embodiment of the present invention, a receiving force for fixing the carrier element is adjusted by means of the dimensioning of the at least one recess. In this way, the protrusions may be safely retained within the recesses in the upper edge at the distal end of the shaft.

In a further preferred embodiment of the present invention, the receiving opening is in the shape of a blind-hole-like depression which preferably comprises a rectangular, an elliptical, a circular, a n-corner or a regular polygonal form. This has proven to provide for optimized handling characteristics.

In a further preferred embodiment of the present invention, the carrier element and the shaft are connected to one another by means of positive fit and/or force fit and/or material fit. Usually, the connection is realized in the form of a snap connection, by ultrasonic welding, by injection molding, by bonding and/or crimping and/or by heat exposure. The choice of the connection variant depends on the actual field of application and the mechanical stress on the applicator during use.

In a further preferred embodiment of the present invention, the carrier element and the shaft are inseparably connected during intended use. This means that the carrier element and the shaft may not be disassembled without being destroyed.

Inseparably in this relation means, that for separating the carrier element and the shaft a force of at least 300 grams, preferred more than at least 500 grams and most preferred more than 1000 grams has to be applied till the parts break. In this case the force is applied on the carrier parallel to the longitudinal axis of the shaft.

In a further preferred embodiment of the present invention, the bristle elements merely comprise a free end and a mounting end (which is the melted end of the bristle elements). This is because the bristle elements are applied in an anchor-free manner. Bristle elements which are fastened by means of anchors are usually longer and comprise two free ends (U-shaped configuration when mounted) and a metal anchor such as a piece of wire or a metal plate is used to secure the bristle elements.

In a further preferred embodiment of the present invention, the melted ends of the bristle elements are connected to the carrier element by means of positive fit and/or force fit and/or material fit. Usually, the connection between the melted ends of the bristle elements and the carrier element and/or the shaft is realized by welding by hot stamp (by contact with a hot stamp), ultrasonic welding, injection molding, bonding and/or crimping and/or heat exposure and/or pressure exposure and/or assembling the carrier element to the shaft and/or fixing the melted ends of the bristle elements between the carrier element and the shaft. The choice of the connection variant depends on the actual field of application.

In a further preferred embodiment of the present invention, the carrier element comprises a central opening which is provided with bristle elements. The central opening is either in the form of a through hole or in the form of a blind hole. The carrier element may also comprise multiple through holes and/or blind holes. In particular there may be 2, 3, 4, 5, 6, 7 or 8 through holes and/or blind holes. The shape of the central opening(s) or recesses/openings depends on the number, size and/or configuration of the bristle elements/bristle bundles used.

In a further preferred embodiment of the present invention, the carrier element is substantially ring-shaped. In the present case, ring-shaped includes circular but also oval and elliptical shapes. Also, angular shapes with rounded corners may be ring-shaped in accordance with the present invention.

In a further preferred embodiment of the present invention, the bristle elements are over-molded at the mounting ends wherein the over-mold section preferably forms the carrier element. This is a particularly cost-efficient procedure.

In a further preferred embodiment of the present invention, the carrier element comprises at least one fastening means which serves for a connection with the shaft. Usually, the at least one fastening means is formed hook-like or nose-like or tongue-like. In this manner, a particularly efficient and stable assembly of the applicator may be ensured.

In a further preferred embodiment of the present invention, the at least one fastening means is preferably arranged at the longitudinal side of the carrier element. This has proven to be advantageous because more space for the connection mechanism is provided. However, it is also conceivable that the fastening means are arranged at the narrow sides of the carrier element, i.e. depending on the actual application.

In a further preferred embodiment of the present invention, the at least one fastening means of the carrier element comprises a length between 1 mm and 6 mm preferably between 2 mm and 4 mm and a height between 0.1 mm and 0.6 mm, preferably between 0.15 mm to 0.4 mm.

In a further preferred embodiment of the present invention, there is provided at least one recess for receiving the fastening means of the carrier element at the longitudinal or wide side of the distal shaft end, in the area of the receiving opening. Usually, the at least one recess is in the form of a through hole or slot.

In a further preferred embodiment of the present invention, the at least one recess in the upper edge of the shaft comprises a width between 0.4 mm and 2 mm, preferably between 0.6 mm and 1.5 mm and a depth between 0.3 mm and 1.2 mm preferably between 0.4 mm to 0.8 mm.

In a further preferred embodiment of the present invention, a snap connection is formed between the fastening means of the carrier element and the recess in the distal shaft end in the mounted state. In this manner, the carrier element and the shaft may be assembled in a comparatively easy and reliable manner.

In a further preferred embodiment of the present invention, the carrier element is inserted into the shaft along the longitudinal axis. This ensures a very smooth assembly of the applicator.

In a further preferred embodiment of the present invention, there is provided at least one fastening means for realizing a connection with a grip element at the proximal shaft end. Usually, the at least one fastening means at the proximal end of the shaft is in the form of a thread or in the form of latches. In this way a variety of grip elements may be connected to the shaft, i.e. depending on the specific application. For example, the applicator device is in the form of a nail polish brush, a lip gloss brush, a mascara brush, a cosmetic brush, an interdental cleaner or a single tuft brush or the like.

In a further preferred embodiment of the present invention, the bristle elements are provided in the form of at least one bristle bundle. Preferably, the at least one bristle bundle comprises one, two, three or more bristle elements of different bristle types which may be combined in any desired manner. The at least one bristle bundle may comprise one-component bristle elements or multi-component bristle elements (made from two or more material components) or a mixture thereof. The multi-component bristle elements may comprise: (a) a core with one or more resins and one outer layer with one or more resins wherein the outer layer surrounds the core or (b) two or more components embodied to be linked with each other, preferably on a longitudinal axis. Also, the bristle elements comprise at least one thermoplastic resin. The at least one thermoplastic resin may be selected from the group of polyolefines, polyamides, polyesters, polycarbonates, polyoxymethylenes, polyether ketones, polysulfones, polyether sulfides, thermoplastic polyether imides and/or thermoplastic polyimides. It is also possible that different regions of the applicator device comprise at least one bristle bundle with bristle elements of different properties, preferably a different material component composition and/or bristle elements containing a different masterbatch and/or bristle elements with a different shape in one and/or more sections of the at least one bristle bundle. The different material component composition may be present in one or more portions of the bristle elements and/or in one or more of the bristle elements and/or in one or more sections of the at least one bristle bundle and/or in different bristle bundles comprised in the applicator device. The different properties may be present in one or more portions of the bristle elements and/or in one or more of the bristle elements and/or in one or more sections of the at least one bristle bundle and/or in different bristle bundles comprised in the applicator device. Also, the at least one bristle bundle may further comprise and/or consist of at least one elastomer resin element. In this manner, a great range of variation may be achieved for the applicator device.

In a further preferred embodiment of the present invention, the at least one bristle bundle comprises bristle elements having a diameter in the range from 0, 0254 mm (1 mil) to 0,508 mm (20 mils). This has proven to be an optimum range for the abovementioned applications in practice.

In a preferred embodiment of the inventive method, in step (b) multiple carrier elements being interconnected in a grid-like structure within a frame are injection molded or stamped and/or punched and/or cut of a thermoplastic sheet and provided with bristle elements, wherein the carrier elements are separated into individual parts after the bristle application, for mounting the carrier elements. In this way, a large number of carrier elements may be manufactured in a very efficient manner, i.e. using for example also machines which are usually foreseen for toothbrush production without efficiency loss.

In a further preferred embodiment of the inventive method, the separation procedure is realized by means of punching, cutting, lasering or sawing. In this manner a proper and reliable separation may be ensured.

In a further preferred embodiment of the inventive method, the free ends of the bristle elements are mechanically, physically and/or chemically treated before step (b). For example, the bristle elements may be pointed, rounded-off and/or colored at their free ends.

In a further preferred embodiment of the inventive method, before step (b) the mounting ends of the bristle elements are at least partially connected, in particular melted, to one another. This ensures a safe fixation of the bristle elements to one another and/or to the carrier element of the inventive applicator device. In case more than one bristle bundle is used, the melted mounting ends of the bristles of at least two bristle bundles are connected with/via the melt carpet creating additional retention for the bristle bundles in the carrier element. However, depending on actual use of the applicator it may be preferable to keep the melt carpet of the melted mounting ends of the bristles of at least one bristle bundle separated from the respective melt carpet of other bristle bundles.

In a further preferred embodiment of the present invention, there is provided a base element connected to the proximal end of the shaft. The base element preferably serves to connect a grip respectively handle to the shaft. A fastening means may be arranged on a rear side of the base element for connecting the grip respectively handle part to the shaft.

In a further preferred embodiment of the present invention, the shaft is manufactured separately of the base element. Alternatively, the shaft comprising the base element may be manufactured as an integral piece.

In a further preferred embodiment of the present invention, the shaft and the base element are connected by a positive fit and/or a force fit and/or a material fit. The connection can be achieved for example by snapping, welding and/or glueing the parts.

In a further preferred embodiment of the present invention, the applicator device comprises a fluid channel extending, preferably centrally, through the shaft and the carrier element. The fluid channel preferably connects an end or an inner side of the base element through the shaft and the carrier element to the bristle elements. Preferably, the fluid channel comprises a first fluid channel part and a second fluid channel part, wherein the first fluid channel part is arranged within the shaft and the second fluid channel part is arranged within the carrier element, wherein the first and second fluid channel parts communicate with each other when the shaft and the carrier element are assembled. Preferably, an inner wall of the first fluid channel part and an inner wall the second fluid channel part are flush at the interface of the shaft and the carrier element when the shaft and the carrier element are assembled respectively the carrier element is connected to the shaft.

Further Matters Concerning the Present Invention

It is basically the aim of the present invention to provide a plastic piece with bristle elements which may be mounted at a shaft later. This plastic piece is in the form of an anchor-free applicator for various brush applications.

According to the present invention, the following components are preferably provided: a grip, a shaft, a carrier element (usually but not necessarily in the form of a plate or platelet—round or concave respectively pill-like shapes are also possible), bristle elements or bristle bundles which together result in the finished applicator device.

The carrier elements are formed by means of two- or multi-component injection molding in a corresponding mold tool or by stamping and/or punching and/or cutting a sheet made from a hard material component. Preferably, the carrier elements are arranged within a frame. The carrier elements are arranged in a grid like manner.

An interface between the shaft and the carrier element is provided for connecting the two parts. Preferably fastening means at the shaft and corresponding fastening means at the carrier element are provided for this connection. Preferably, a fastening means which projects from the carrier element is provided which may for example snap into a recess in form of a through hole or slot in the shaft.

Construction of the Shaft

The design of the shaft is generally known from existing applicators. The shaft is preferably produced with elements at its proximal end which enable the connection with a grip portion, as for example a thread; other possibilities would be snapping or welding means and the like.

The shaft is usually a part which is formed by injection molding and preferably consists of a hard material component. Preferably, the shaft consists in its supporting structure of a hard component, but it may also comprise soft material component portions, as for example when the grip portion is directly formed onto the shaft or when additional functional elements shall be provided.

The shaft may be configured without a base element which enables connection to for example a grip structure respectively handle. Therefore, the shaft may be manufactured separately from said base element.

A separate manufacturing of the shaft and the base element may particularly be advantageous if a further processing of the shaft should be done. For example, if the shaft is provided with a printing or an imprint, the printer head usually needs to be below or at a defined maximum distance from the substrate (e.g. the shaft). Due to the printer head having a certain size and the requirement of the maximum distance between substrate and printer head, a collision may occur between the base element and the printer head while attempting to apply a printing onto the shaft. Thus, conditions which allow the printing of the substrate/shaft can be provided or improved by forming the base element separately from the shaft and assembling the base element and the shaft after printing on the shaft. The shaft and the base element are preferably connected by a positive fit and/or a force fit and/or a material fit. The connection can be achieved for example by snapping, welding and/or glueing the parts.

By separating the manufacture of the shaft and the base element the shaft itself can be made more accessible. This improved accessibility can also be exploited for other processing methods than printing. For example, other processing methods may be—assembling further parts to the shaft, applying an embossing or other decoration work.

Preferably, a fluid channel part is formed within the shaft, further preferably centrally within the shaft. This part of the fluid channel may guide an applicator medium such as a fluid from a tank next to the base element to the carrier element.

Dimensions

The length measured from the interface shaft—carrier element to the interface shaft—grip (i.e. the length of the shaft itself) ranges from 15 mm to 70 mm, preferably from 35 mm to 50 mm. The width ranges from 4 mm to 12 mm, preferably from 5 mm to 9 mm. The depth (respectively thickness) ranges from 2 mm to 6 mm, preferably from 2.5 mm to 5 mm.

Shape

Generally, the shape of the shaft is such that it may correspond with a reservoir (i.e. a fluid container respectively a container for applicator medium). This can be achieved for example by means of storage within the reservoir—as is the case with a nail polish brush—such that the applicator medium may e.g. be removed from the reservoir for application on nails.

The aim is to provide a surface which is as smooth as possible in order that the applicator medium only sticks to the portion containing the bristle elements and no waste (or as little as possible) of the medium occurs.

The longitudinal shape of the shaft is preferably cylindrical, especially preferred is a straight cylinder.

Alternatives may be a bent shape (e.g. banana-like) and/or a wavy shape.

Cross-Section

The cross-section of the shaft may be round (i.e. circular, oval and/or elliptical); a regular n-corner or polygonal shape; triangular (e.g. an equilateral triangle or an isosceles triangle); rectangular (preferably a rectangle with rounded corners); square; trapezoidal rhomboidal; dragon-shaped; kidney-shaped or bone-shaped.

Generally, if there are angular basic shapes, the corners are preferably rounded. In all shapes concave indentations, for example in the form of bent sides or in the form of stabbed portions are possible. Preferably, the basic shape corresponds to the outer shape of the carrier element such that a uniform wall thickness may be reached which may correspond to the opening contour of the carrier element.

Interface Shaft/Carrier Element

The interface is positioned at the free end of the shaft, which is the end that is facing away from the grip portion.

The shaft may comprise the following elements for the interface which are responsible for an easy assembly process and the fit of the carrier element to the shaft: a receiving opening in the distal end of the shaft, recesses which are preferably in form of notches in the upper edge of the receiving opening/shaft and recesses in form of slots or through holes in the side walls of the shaft and a support collar.

The receiving opening is usually formed as a blind-hole like depression in the distal end of the shaft. The blind-hole like depression may have a conical design, which may be achieved by means of the production conditions respectively the de-forming operation during the injection molding process. The conical design may be advantageous for mounting the carrier element with a corresponding shape.

The shape or cross-section is preferably rectangular or rectangular-like respectively a rectangle with rounded corners. The shape usually corresponds with the shape of the carrier element.

The shaft may comprise a tube-like extension in the distal shaft end for the interface between shaft and carrier element, which may comprise an interface between the fluid channel part of the shaft and the fluid channel part of the carrier element. The tube-like extension may be arranged in the receiving opening or the depression of the receiving opening, respectively. The shaft and the carrier element are preferably aligned such that the applicator medium may move through the fluid channel without leakage between the fluid channel parts. The fluid channel is preferably arranged centrally within the shaft and/or the carrier element.

Design

Seen in the cross-section, the depression comprises a step 1 with a depth $d_{d1}$ which includes the notches and the recesses. The cross-section also comprises a step 2 with a depth $d_{d2}$ which begins at the support collar and forms a hollow space.

Dimensions

The total depth of the depression is depth $d_{d1}$ plus depth $d_{d2}$ and ranges from 1 mm to 4 mm, preferably from 2.5 mm to 3 mm. Thereby, depth $d_{d1}$, seen from the free end, ranges from 1.5 mm to 4 mm, preferably from 1.7 mm to 3 mm. Depth $d_{d2}$ which follows depth $d_{d1}$ ranges from 0.5 mm to 2.5 mm, preferably from 0.6 mm to 1.5 mm.

Seen in the cross-section, the length of the depression is from 4 mm to 8 mm, preferably from 5.5 mm to 6 mm and the width of the depression is from 0.5 mm to 3.5 mm, preferably from 1.5 mm to 2.5 mm. The conicity per side ranges from 0° to 5°, preferably from 0.5° to 2°.

The walls of the shaft comprise a wall thickness which ranges from 0.2 mm to 1 mm, preferably from 0.3 mm to 0.6 mm; preferably the wall thickness is identical in the whole cross-section. Yet, there are different wall thicknesses in different depths.

The preferred wall thickness allows flexing the side walls and therefore an easy assembly process of the carrier element to the shaft.

Alternatives

Supporting pins and/or supporting elements may be arranged within the depression for supporting and/or holding the melt carpet. The supporting pins/elements may be arranged within the hollow space of the depression, for example as small cylinders which protrude from the bottom into the depression and which contact the melt carpet.

The supporting pins/elements may be deformed during the assembly process of the carrier element to the shaft. The supporting pins/elements may exercise a minimal pressure to the melted ends of the bristle elements. In this manner, it is possible to control the variation of different sizes of melt carpets of the bristle elements during production.

Recesses (Notches)

The depression comprises on its open side within the upper edge recesses, preferably in form of notches. The recesses receive the protrusions of the carrier element in the mounted state because the latter shall not project from the end product.

In the plan view the recesses (notches) are preferably U-shaped. Alternatively, the recesses/notches may be V-shaped. The edges are preferably rounded (on the upper side and on the lower side).

Usually, one to four (1, 2, 3, 4) recesses are provided in the border area, preferably two recesses and at least one recess. The width of the recesses ranges from 0.4 mm to 2 mm, preferably from 0.6 mm to 1.5 mm. The depth of the recesses ranges from 0.3 mm to 1.2 mm, preferably from 0.4 mm to 0.8 mm. The recesses are arranged in a symmetrical way.

The recesses separate the upper edge of the shaft. In case of one recess an interruption results and in the case of two recesses two independent or separated surfaces result.

Recesses in the side walls of the shaft (e.g. slots or through-holes)

These recesses are located in the walls of the blind-hole like depression and are usually formed as slots or through-holes. They serve for receiving the fastening means of the carrier element. Alternatively, these recesses may also be formed as blind-holes open from the inside of the walls of the blind-hole like depression of the shaft.

Their position, measured from the free respectively distal end of the shaft in the longitudinal direction of the shaft up to the lower edge of the recess is from 0.5 mm to 4 mm, preferably from 1.3 mm to 2.8 mm. They are preferably centered in the width of the respective side and are preferably arranged on the longitudinal (wide) side of the shaft. Preferably they are formed on a different side than the recesses (notches) in the upper edge.

Seen in the cross-section, i.e. when looked onto the recess from outside, at least the upper side is formed straight. In this context it is important that there is enough space for the fastening means of the carrier element. Normally, the cross-section is shaped rectangular wherein the sides are rounded. The size decreases in the direction of the depression. On the upper side there is provided a pulling section (i.e. a counterpart to the carrier element). Alternatively, the upper side comprises a straight shape.

There are provided one to four, preferably two (opposed) recesses in the sidewalls of shaft.

The length of the recesses in the sidewalls of the shaft ranges from 2.5 mm to 5 mm, preferably from 3 mm to 4 mm. The height (seen in the longitudinal direction of the shaft) ranges from 0.4 mm to 1.4 mm, preferably from 0.6 mm to 0.9 mm, measured on the outside of the shaft. The surfaces are preferably arranged in an angle against the inside (i.e. the surfaces taper inwards—in direction to the depression of the receiving opening).

The support collar generally serves as an insertion stop for the carrier element in the blind-hole like depression and it may also serve for clamping the melt carpet, when the melt carpet in the mounted state lies between the carrier element and the support collar.

Further the interaction of clamping the fastening means into the recess and the support collar is designed in a way that the carrier element and the shaft are clamped side by side. So the parts are hold accurately fitting together.

The support collar is located within the depression, i.e. between the first cross-sectional step (depth $d_{d1}$) and the second cross-sectional step (depth $d_{d2}$). The width of the support collar (i.e. between depth $d_{d1}$ and depth $d_{d2}$) ranges from 0.1 mm to 0.5 mm, preferably from 0.15 to 0.35 mm.

Carrier Element

Usually, the carrier element is a rather small plate-like plastic part made from hard material component (and optionally other material components) which forms the basis and holding means for finished bristled carrier.

The carrier element is a part which is formed using the injection molding process. Alternatively, the carrier elements may also be formed by stamping and/or punching and/or cutting a sheet of hard plastic component. It consists preferably of a hard component, in particular in the area of the interface, namely the contacting components and the components which serve for holding the carrier element.

Further material components may be used. Preferably, such further material components form a material fit with the hard material component of the carrier element. For example, other parts or sections of the carrier element may be made from a soft material component, as for example application elements made from a soft material component. The latter may be directly injected or formed onto the carrier element and are of course flexible. Also, individual flexible zones may be provided in order that the carrier element may become resilient at least in certain regions which brings about a flexibility of the carrier element and of the bristle elements/bristle bundles with respect to the shaft.

Also, components for injection molded bristle element parts, e.g. for application elements in the form of injection molded bristle elements are conceivable. Also conceivable are combinations of different features from different components, as for example injection molded bristle elements on a flexible carrier element and/or injection molded bristle elements combined with application elements made from a soft material component.

The outer shape of the carrier element corresponds to the shape of the shaft—under the pre-condition that the thickness of the wall of the shaft is uniform. Preferably, the outer shape is flat but it may also comprise a topography (fully or only in parts).

The length of the carrier element ranges from 4 mm to 9 mm, preferably from 5 mm to 7 mm. The width of the carrier element ranges from 1 mm to 5 mm, preferably from 1.5 mm to 3 mm.

The thickness of the carrier element in the main part ranges from 1 mm to 3.5 mm, preferably from 1.5 mm to 2.5 mm. In the area of the fastening means the thickness is rather small and ranges from 0.3 mm to 1.2 mm, preferably from 0.5 mm to 0.8 mm, to enhance the separation of the part from the frame.

The carrier element may comprise a fluid channel part. The fluid channel part is preferably formed as through hole. A distal end of the fluid channel part may form a fluid outlet arranged at an upper side of the carrier element. The fluid outlet is preferably arranged between the bristles or bristle bundles or at a side of the bristles or of one or more bristle bundles.

Interface

Elements at the carrier element include the outer geometry of the carrier element, the fastening means and the protrusions.

The fastening means provide for the anchorage of the carrier element within the shaft. They are usually shaped hook-like or tongue-like or nose-like such that a snap connection is formed between the recess in the shaft and the fastening means.

Usually the parts connected by the snap connection are inseparably connected during the intended use. This also means that the assembly is normally just once possible since the disassembly forces parts to break.

The fastening means may be shaped in the cross-section arrow-like. There is an infeed-chamfer for the mounting procedure, i.e. such that the carrier element may be securely inserted into the depression within the shaft. Different angles may be provided for the front flank (infeed-chamfer) and the rear flank.

The fastening means are preferably formed at the longitudinal or wide side of the carrier element and are mounted in corresponding recesses of the shaft.

The length of the fastening means ranges from 1 mm to 6 mm, preferably from 2 mm to 4 mm; or expressed in % of the overall length of the carrier element in the range of 35% to 80%, preferably of 40% to 75%.

The height of the fastening means ranges from 0.1 mm to 0.6 mm, preferably from 0.15 mm to 0.4 mm.

Usually, one to four, preferably two fastening means are provided at the carrier element.

The protrusions are preferably positioned on the narrow sides of the carrier element (and protrude outwardly). The protrusions are remainders of the production according to the injection molding method (i.e. after the separation from the grid-like structure).

Specific embodiments for various bristle application methods, respectively bristling methods According to the anchorless AFT method, a feature of the carrier element is the central opening. The carrier element respectively carrier plate usually forms a base with a closed outer contour which serves for a good connection to the shaft.

In the case of one central opening, the basic shape is frame-like which may comprise a ring-shaped design (torus) i.e. there is a uniform wall thickness with the exception of the fastening means and the (lateral) protrusions.

According to the anchorless Hot Tufting-method, features at the carrier element are e.g. in the form of one or more recesses in the form of a blind-hole. Regarding the shape, there is no frame but a fully filled element with blind-holes. There are recesses for the bristle elements which comprise a depth ranging from 0.5 mm to 8 mm, preferably from 1.5 mm to 5 mm.

According to anchorless IMT-method (in-mold-technology), the carrier element is directly injected/overmolded onto the bristle elements wherein the overmold forms the carrier element. No recesses are formed for the bristle elements since the bristle elements are over-molded forming the necessary recess by themselves during the over-molding process.

In the least preferred anchor-punching or loop-punching method, the components at the carrier element include one or more recesses in the form of blind holes. The shape of the blind holes is round or rounded, respectively square. The size of the holes is limited. The bristle elements are directly punched into the carrier element.

General Matters

The dimensions of the individual recesses/central openings for the bristle elements are as follows. The length ranges from 3 mm to 8 mm, preferably from 4.5 mm to 6 mm and the width ranges from 0.5 mm to 2 mm, preferably from 0.6 mm to 1 mm. The inclination of the recess/hole respectively of its walls, from the back side of the carrier element to the front side of the carrier element, ranges from 1° to 3°, preferably from 1.5° to 2.5°, whereby the recess is on the back side wider than on the front side.

The shape respectively the cross-section of the recesses/central openings is preferably round (i.e. circular, oval, elliptical or regular n-corner or polygonal shape); triangular (equilateral or isosceles triangle); rectangular (preferably a rectangle with rounded corners); square, trapezoidal, rhomboidal, dragon-shaped, kidney-shaped or bone-shaped.

In general, the corners of angled basic shapes are preferably rounded. In all shapes, there are concave indentations, for example in form of bent sides or in the form of indentations possible.

Preferably, the shape of the recesses/central opening of the carrier element follow/correspond at least partially to the outer shape of the carrier element because in this manner, a uniform wall thickness may be reached which may also correspond to the hole contour of the carrier element.

There may be one or more recesses respectively (central) openings for the introduction of the filaments. Preferably the arrangement of the recesses/openings is central and/or symmetrical, and the number of recesses/openings may be 1, 2, 3, 4, 5, 6, 7 or 8 or more.

The number of bristle picks (i.e. of filaments) per recess/opening is 1, 2, 3, 4 or 5 (in some cases even more), wherein one bristle pick corresponds to the number of bristle elements which are caught by the bristling machine during one machine cycle.

Further, the number of bristle types per recess/opening respectively per bristle bundle usually corresponds to the number of bristle picks per recess/opening, i.e. 1, 2, 3, 4, 5 bristle types per recess. The maximum number of bristle types in a recess is the number of bristle picks used for filling the recess/opening. Usually there are some bristle picks with the same bristle type in one recess. One recess/opening preferably corresponds to one bristle bundle.

Under the term "bristle type" usually one sort of bristle elements is understood. Different bristle types may differ from each other by diameter and/or color and/or size and/or tip shape and/or material and/or master-batch ingredients etc. If however the bristle elements are pre-mixed in the supply operation, this also corresponds to one bristle type, although for example two different bristle elements are used.

The number of bristle elements per recess/opening generally depends on the size of the recess/opening. The density is normally in the range of 3 bristle elements per $mm^2$ to 35 bristle elements per $mm^2$, preferably from 8 bristle elements per $mm^2$ to 25 bristle elements per $mm^2$.

The connection of the bristle elements is usually achieved by means of heat treatment/exposure. For instance, a hot stamp or a hot plate is used. In a contactless alternative an infrared-device or a laser device may be used.

The resulting bristle melt carpet may extend over multiple recesses/openings and bristle bundles, which is for example the case with the AFT method.

Alternatively, there may be only one melt carpet per recess/opening and bristle bundle, i.e. in the form of carpet like or mushrooms-like or ball-like ends of the bristle bundle with one melt carpet per recess/opening—which may be the case for example with Hot Tufting or IMT.

The surfaces of the melt carpets range from 1 $mm^2$ to 12 $mm^2$, preferably from 3 $mm^2$ to 5 $mm^2$.

Grid—for the Production of the Carrier Element

In general, a grid-like structure is formed by means of injection molding or stamping and/or punching and/or cutting a sheet made of hard material component which has multiple integrated carrier elements. Due to the small dimensions, multiple carrier elements respectively plates are produced together (injection molding and bristling) in order that existing machines (e.g. for toothbrush production) may be used with high cycle rates. This applies for all the different bristling procedures, respectively methods.

Production aspects include that the injection point is located at the frame of the grid-like structure. The carrier elements are preferably oriented in an organized way in their longitudinal direction one behind the other (horizontally). Usually but not necessarily, there is no connection in the transverse (vertical) direction. There may be a connection in horizontal and/or transverse direction.

The arrangement is in the direction of flow, namely: frame—connecting web—carrier element—connecting web—carrier element—connecting web—frame.

The connecting webs (which form the lateral protrusions of the carrier element when separated) comprise a reduction of the thickness in the areas where punching or cutting occurs, and by means of punching onto the connecting webs the protrusions are generated. Preferably, the protrusions are arranged at the narrow sides of the carrier element.

There are recesses in the frame in order that the latter is more stable. Preferably, the frame is rectangular or square with rounded corners.

The frame comprises a length ranging from 20 mm to 40 mm, preferably from 25 mm to 30 mm and width ranging from 10 mm to 30 mm, preferably from 15 mm to 25 mm.

The number of carrier elements per grid-like structure ranges from 2 to 32, preferably 8, 12, 16 or 20. The number generally depends on the size of the individual bristle field, the number of bristle picks of the machine needed for one grid-like structure and on the size of the machine. In particular the number of bristle picks of the machine for one grid like structure should be higher than 20 preferably higher than 30.

The number of carrier elements in a row (direction of the connecting webs) ranges from 2 to 4 preferably 2. The number of carrier elements side-by-side ranges from 2 to 12 (most preferably 8).

Bristled Carrier Element

The introduction of the bristle elements may occur according to the AFT method where the bristle elements are introduced from the rear side i.e. from the side of the fastening means into the carrier element (for example if the AFT method is used the melt carpet may be arranged on this side).

According to the Hot Tufting method the bristle elements are introduced from the bristle side into the blind hole of the carrier element.

According to the IMT method the bristle elements are overmolded—i.e. there are no actual holes within the carrier element respectively plate.

In the anchor- or loop-punching method, the bristle elements are introduced from the bristle side into the blind hole.

Characteristics of the fixed bristle elements include that one end of the bristle element is free (i.e. the use end). The other end is connected to further bristle elements (i.e. the anchorage or mounting end) which may be molten (AFT or Hot Tufting) or the ends are overmolded together (IMT) or fitted together according to the anchor- or loop-punching method.

The shape (cross-section) of the bristle bundles corresponds in essence to the cross-section of the openings.

The bristle element length in the fixed state (measured from the carrier element—i.e. the free length) ranges from 3 mm to 22 mm respectively from 5 mm to 15 mm.

Bristle element cross-sections range from 0.0254 mm to 0,508 mm preferably from 0.0762 mm to 0.3048 mm.

Preferably, the bristle elements are cut and rounded or tapered before they are fixed respectively mounted. The cutting, rounding or tapering processes may occur before or during the mounting process.

The bristle elements or bristle bundles and/or the arrangement of the bristle elements or bristle bundles can be adapted to optimize the applicator medium distribution respectively fluid distribution in connection with the fluid outlet. The fluid outlet may therefore be arranged between the bristle elements or bristle bundles or at a side of the bristle elements or of one or more bristle bundles such that the fluid can directly be guided to a side of the bristle elements.

Finished Applicator

There is a non-reversible connection between the shaft and the carrier element, wherein several connection possibilities exist (cf. above).

The carrier element is introduced along the longitudinal axis into the shaft. The end position between the shaft and the carrier element includes that the upper edge of the shaft corresponds to the upper edge/surface of the carrier element such that there is a flush configuration (which helps to avoid that medium sticks in the area of the interface).

Also, no edges shall project from the side walls of the shaft since it is very important that only as less as possible of the medium is caught or gets stuck to parts except from the bristle elements/bristle bundle(s). Thus, the fastening means and recesses (through-holes) are configured in such a way the fastening means preferably fill in essence the recesses (through-holes) completely respectively precisely.

The tolerances between the carrier element and the shaft range from 0.02 mm to 0.2 mm preferably from 0.04 to 0.1 mm.

The standard orientation of the carrier element is straight. This means that the longitudinal direction of the applicator elements corresponds in essence to the longitudinal axis of the shaft.

There may also be an inclination of the applicator elements, namely in the direction of the wide or the narrow side of the shaft. This means that the bristle elements stand straight in the carrier element but are angled with respect to the shaft. The carrier element is assembled angled to the shaft.

In an alternative embodiment the openings in the carrier element (in the form of through holes or blind holes) may be inclined vs the longitudinal direction of the shaft or carrier element.

If a flexibility is provided within the shaft, the carrier element as a whole may be swiveled with respect to the shaft since it is fixed on the flexible part of the shaft.

Specific Embodiments for Various Bristling Methods

According to the AFT method the melt carpet lies (or is clamped) between carrier element and the support collar. The underside of the melt carpet lies freely, in the direction of the cross-section—step 2, within the depression respectively the hollow space of the receiving opening.

Alternatively, there may be arranged supporting pins in the hollow space (e.g. at the bottom) which are made from the same material as the shaft which abut at the underside of the melt carpet.

According to the Hot Tufting method, the shape of the carrier element changes from the initial state to the bristled state, since the bristle elements are fixed under pressure and heat which leads to a deformation of the carrier element. In this case, the carrier element is designed in a special form, that the final shape after fixing the bristle elements corresponds to the needed final form of the carrier element. Preferably, the retention/fixing means of the carrier element are not deformed during this bristle bundle assembly process.

The IMT and the anchor-punching respectively loop-punching method are also conceivable in this context.

The bristles may consist of the same or of a compatible hard material component as the carrier element and thereby forming a material fit with the carrier element during the assembly process (i.e. overmolding, melting).

Alternatively, the bristles may consist of a different hard material component than the carrier element thereby forming a positive fit with the carrier element during the assembly process. The positive fit is realized in a way that the melt carpet if formed on the back of the openings and recesses of the carrier element. In the assembled state the bristle elements respectively, its melt carpet is fixed between the carrier and the shaft.

The same is also possible for the connection of the carrier element and the shaft, when they are connected by another method than snapping for example by heat or ultrasonic welding.

The shaft may consist of the same or of a compatible hard material component as the carrier element and thereby forming a material fit with the carrier element during the assembly process (i.e. overmolding or welding).

Alternatively, the carrier element may consist of a different hard material component than the shaft element thereby forming a positive fit with the carrier element during the assembly process. The positive fit is realized for example as a snap fit.

Material Components which are compatible and available for carrier elements and bristle elements are for example polyamide (PA) or polyethylene terephthalate (PET).

Alternative Embodiment

The carrier element is put onto the shaft in form of cap. This means that the shaft does not comprise a depression, at most the shaft comprises at its surfaces or side walls indentations for a snap connection. Further the shaft is formed in such a way that with the put-on carrier element the outer surface of the shaft is flush with the outer surface of the carrier element (continuous outer surface). The shaft comprises a reduction in its cross-section which has the size of the wall thickness of the carrier element.

The carrier element may be formed as a cap or hood, i.e. the carrier element comprises at its outer edge a ring (facing away from the bristle elements). Within the ring there may be integrated elements for snapping onto the corresponding receiving section shaft.

The carrier element may also be put onto the shaft in a sleeve-like manner, i.e. the carrier element encloses the shaft at least partially in this manner.

Although these alternative embodiments use different shapes of the shaft and the carrier element, all other aspects of this invention remain valid.

Manufacturing Process

Step 1 includes the injection molding of the shaft, means the manufacturing of the shaft.

Step 2 includes the production of the bristled carrier element.

According to the AFT method a step 2a includes the injection molding of the carrier element within the grid-like structure (or alternatively punching, stamping or cutting a sheet). According to the AFT method step 2b includes that the carrier elements are bristled within the grid-like structure.

According to the Hot Tufting method a step 2a includes the injection molding of the carrier element within the grid-like structure (or alternatively punching, stamping or cutting a sheet). According to the Hot Tufting method a step 2b includes that the carrier elements are bristled within the grid-like structure.

According to the IMT method a step 2a includes that the bristle elements are provided. According to the IMT method a step 2b includes that the provided bristle elements are overmolded under formation of the grid-like structure.

According to the anchor-punching respectively loop-punching method a step 2a includes injection molding of the carrier elements within the grid-like structure. According to the anchor-punching respectively loop-punching method a step 2b includes that the carrier elements are bristled within the grid-like structure.

Step 3 includes separating the carrier elements (unlink) from the grid-like structure.

Step 4 includes that the bristled carrier element is mounted on the shaft.

Generally, a known injection molding process is used with specifically formed parts. The parts include the shaft and the carrier elements within the grid-like structure.

Bristling Methods

AFT

Generally, a known AFT process may be applied with the sequence: (1) grid-like structures/carrier elements and bristle elements are provided and prepared (e.g. bristle elements are rounded or tapered); (2) bristle elements are introduced into the carrier elements from the rear side and (3) the bristle elements and the carrier elements are preferably connected by means of a hot stamp (alternatives include infrared or ultrasonic welding). The connection may be a positive fit and/or a material fit.

Melting is accomplished with a melting stamp. Preferably a flat stamp is used whereby most preferably only one hot surface is used.

Alternatively, a sub-divided stamp may be provided having one hot surface per separate melt carpet.

Regarding the melt carpet it is the aim of the present invention to provide a melting within the area of the bristle element ends so that there is no flow into the bristle bundles.

Preferably, there is one melt carpet per carrier element which results in multiple melt carpets per grid-like structure/frame. There shall be no melt carpet extending over the outer edge of the single carrier element. However, in another embodiment there may be also multiple melt carpets per carrier element, more particular 2, 3, 4, 5, 6, 7 or 8 individual melt carpets per carrier element.

Aspects regarding the melt carpet include the volume of protruding bristle elements which define the thickness of the melt carpet. Further, the temperature of the stamp is important (higher temperatures required as for the production of toothbrushes in order that the melt carpet does not expand too far). Temperatures used are preferably between 540° Celsius and 570° Celsius; compared to this the temperatures used when melting toothbrush bristle elements are significantly lower i.e. usually between 4200 Celsius to 450° Celsius. Also, shorter times are required as in the production of toothbrushes. Generally, the aim is to provide much heat in a short period of time.

The thickness of the melt carpet ranges from 0.1 mm to 0.5 mm (preferably 0.3 mm) and further preferred not smaller than 0.15 mm. The length of the protruding bristle elements (before melting) from the carrier element ranges from 0.2 mm to 0.8 mm preferably from 0.3 mm to 0.6 mm.

The machine speed is around 1000 bristle picks per minute (i.e. number of placed groups of bristle elements) such that around 280 carrier elements may be formed/filled per minute, when 3 to 4 bristle picks are filling the recesses/openings of one carrier element. This equates to around 18 filled grid-like structures a minute.

The bristle pick density is usually three bristle picks per bristle bundle. However, depending of the use of the applicator 2, 4, 5, 6, 7, or 8 bristle picks per bundle may be foreseen. The bristle picks may also comprise different sizes (i.e. a different number of bristle elements and/or a different picking area of bristles). Further, the bristle picks may be made of different or of the same kind of bristle elements. Differences are for example possible with regard to the bristle type (i.e. pointed, cylindrical or spiral like bristles); with regard to the bristle material (cf. above) or with regard to the color of the bristle elements.

Hot Tufting

Generally, a normal Hot Tufting process is applied. The sequence is (1) grid-like structure/carrier element and bristle elements are provided and prepared (e.g. bristle elements are rounded or tapered), (2) the bristle elements are melted, preferably by means of infrared, (3) the grid-like structure is preheated and (4) the bristle elements are introduced into the grid-like structure and are connected by means of pressure.

IMT

Generally, a normal IMT process is applied. The sequence is (1) the prepared bristle bundles are provided and are introduced into the injection molding machine, (2) overmolding (i.e. the formation of carrier elements with grid-like structure).

Anchor-Punching/Loop-Punching Method

The sequence is (1) grid-like structure/carrier element/bristle elements are provided, (2) the bristle elements are punched, (3) the bristle field/bristle bundles/bristle elements is profiled and (4) the bristle elements are rounded.

In another embodiment depending on the use of the applicator, there may be combinations of above-mentioned methods.

Separation

The carrier elements respectively plates are separated from the grid-like structure. The separation is carried out after the bristling, preferably during mounting i.e. just before mounting. In another embodiment, the carrier elements may be separated before the bristling. This may be preferable especially if the carrier element is punched, stamped or cut from a sheet of hard material component.

The preferred method for separation is punching. Alternative methods include lasering, sawing, cutting or breaking-off which is less preferred since there is the danger of forming sharp edges.

Mounting

The carrier elements are mounted with their rear side into the shaft.

Between the carrier elements and the shaft there is formed a positive fit and/or a force fit and/or a material fit, which all result in a non-reversible connection between shaft and carrier element.

The anchorage preferably occurs by means of a snap connection. Alternatives, in addition to the snap connection or independent thereof (if independent, the fastening means and the recesses are not necessary) include: a mechanical connection, force fit, positive fit or material fit, welding (for example ultrasonic welding), overmolding (the carrier element is overmolded with the shaft: the carrier element with the bristle bundle is located in an injection mold and the shaft portion is overmolded to the carrier element at its rear end) bonding and/or crimping and/or gluing. All alternatives may of course be combined with one another.

Application Elements

Conventional, Extruded Bristle Elements

The bristle elements used herein are generally made from a hard and/or soft material component. Conventional, extruded bristle elements (pointed or cylindrical) are usually made of polyamide (PA) or polyester (PBT).

Manufacturing

The bristle elements are manufactured by means of extrusion (one material component is used) or by means of co-extrusion (more than one material component is used). In contrast to the injection molded bristle elements or rubber elastic massage and cleaning elements which are manufactured using the injection molding method, conventional bristle elements are extruded, cut, processed and introduced in a toothbrush or applicator head by means of an adopted process (e.g. AFT, IMT or Hot Tufting).

Conventional, extruded bristle elements usually comprise one of the following longitudinal shapes: cylindrical, pointed (chemically or mechanically pointed, in particular if the bristle elements are made from polyester (PBT)), wavy or twisted or helical.

The cross-sectional shape may be: circular, round, triangular, rectangular, square, elliptical, polygonal, cross-shaped, trapezoidal, parallelogram-like, or rhomboidal.

All above-mentioned shapes may have hollow sections in the longitudinal direction. There may be 1, 2, 3 or 4 hollow sections.

For cosmetic use the diameter of the bristle elements ranges from 0.025 mm to 0.2 mm and the cross-sectional surface ranges from 0.001 mm to 0.15 $mm^2$.

The surface of the bristle elements is usually smooth but for some applications it may also be textured.

Further, all different sorts of colors are conceivable for the bristle elements. Within the product it is also possible to distinguish different bristle elements and/or bristle types by means of different colors. In addition different colors of bristle picks in one bristle bundle may indicate different properties of the particular section of the bristle bundle defined by the bristle picks.

The arrangement of the bristle elements is generally in form of bristle bundles. Rubber elastic massage and/or cleaning and/or application elements usually consist of a soft material component and are manufactured using an injection molding process. Preferably, these elements are manufactured together with the carrier element in a multicomponent injection molding process. Preferably, the soft material component of these elements form a positive fit and/or a material fit to the hard material component of the carrier element.

Injection molded bristle elements are made of a material component for injection molded bristle elements and are manufactured using an injection molding process. Preferably, these elements are manufactured together with the carrier element in a multicomponent process. Preferably, the material component for the injection molded bristles form a form and/or a material fit to the hard material component of the carrier element. In a special embodiment there may be no material fit.

Material Components

In a preferred embodiment of the present invention, the hard material component(s) are preferably made of styrol polymerisate as for example styrene acrylonitrile (SAN), polystyrene (PS), acrylonitrile butadiene styrene (ABS), styrene methyl methacrylate (SMMA) or styrene butadiene (SB); polyolefins as for example polypropylene (PP) or polyethylene (PE) (preferably also in form of high density polyethylene (HDPE) oder low density polyethylene (LDPE)); polyesters like polyethylene terephthalate (PET) in form of acid-modified polyethylene terephthalate (PETA) or glycol-modified polyethylene terephthalate (PETG), polybutylene terephthalate (PBT), acid-modified polycyclohexylene dimethylene terephthalate (PCT-A) or glycol-modified polycyclohexylene dimethylene terephthalate (PCT-G); cellulose derivatives like cellulose acetate (CA), cellulose acetobutyrene (CAB), cellulose proprionate (CP), cellulose acetate phthalate (CAP) oder cellulose butyrene (CB); polyamide (PA) like PA 6.6, PA 6.10 or PA 6.12; polymethyl methacrylate (PMMA); poly carbonate (PC); polyoxymethylene (POM); polyvinylchloride (PVC); polyurethane (PUR) and/or from polyamide (PA).

In a further preferred embodiment of the present invention the hard material component is made of polypropylene (PP) with an elastic modulus of 1000 to 2400 N/mm$^2$, preferably of 1200 to 2000 N/mm$^2$ and particularly preferred of 1300 to 1800 N/mm$^2$. These materials show in practice particularly preferred flexibility and assembly characteristics.

Hard material is preferably used in instable structure supporting elements, i.e. for example in the grip, in the shaft or in the carrier element.

If various hard materials are used (e.g. in two- or multi-component injection molding) or if the materials are connected by ultrasonic welding, the used hard materials usually form a material fit with one another.

Alternatively, various hard materials may be used, which do not form a material fit in two- or multi-component injection molding. In these pairings, a positive fit is provided (e.g. by undercuts and/or breakthroughs and/or partial or full overmolding, etc.). The second injection molded hard material then shrinks during cooling onto the first injection molded hard material and thus forms a shrink connection. Examples for possible hard material pairings which do not form a material fit are polypropylene und polyester or else polypropylene and styrene acrylonitrile.

In a preferred embodiment of the present invention the soft material component(s) is/are made of a thermoplastic styrene elastomer (TPE-S) (preferably a styrene ethylen-ebutylene styrene copolymer (SEBS) or styrene butadiene styrene copolymer (SBS)); a thermoplastic polyurethane elastomer (TPE-U); a thermoplastic polyamide elastomer (TPE-A); a thermoplastic polyolefine elastomer (TPE-O); thermoplastic polyester elastomer (TPE-E) and/or silicone.

Polyethylene (PE) und polyurethane (PU) may be used as a hard material as well as a soft material component.

Preferred soft material components are thermoplastic elastomers (TPE's) with a Shore A hardness less than 90, preferably of less than 50 and further preferred less than 30.

Contrary to conventional, extruded bristle elements, injection molded bristle elements are made according to the injection molding method.

Particularly preferred materials for the injection molded bristle elements are thermoplastic polyurethane elastomers TPE-U. Modifications with regard to standard TPE-U are for example improved flow properties as well as a faster solidification (i.e. a faster crystallization wherein the molecular chains already connect at high temperatures).

Alternative materials are Polyethylene (PE) for example in the form of low density polyethylene (LDPE) or thermoplastic polyester elastomers (TPE-E) or thermoplastic polyamide elastomers (TPE-A).

The materials for injection molded bristle elements are further preferred thermoplastic elastomers and comprise a Shore D hardness of 0 to 100 preferably of 30 to 80. For injection molded bristle elements special forms of soft material components are used which regularly comprise a higher shore hardness as soft material components from which soft-elastic cleaning/massaging elements or handle portions or e.g. tongue cleaners are made.

During the injection molding process (two or multi-component injection molding) the materials for injection molded bristle elements regularly do not form a material fit with other used soft and/or hard material components. Consequently, for possible compounds with other hard respectively soft material components a positive fit is provided (e.g. by undercuts and/or breakthroughs and/or partial and/or full overmoldings, etc.). The second injected material for the injection molded bristle elements shrinks onto the first injected hard or soft material components and thus forms a shrink connection.

As specific materials, bioplastics may be used in the context of the present invention (i.e. plastic materials which include renewable raw materials) or else water-soluble polymers.

Bioplastics consist of raw materials and of base materials. Possible raw materials are: maize, hemp, sugar, *ricinus* oil, palm oil, potatoes, wheat, cane, natural rubber, wood, castor plant/wonder tree. Examples for base materials include: cellulose, starch, lactic acid (PLA), glucose, chitin and/or chitosan.

The main groups of bioplastics are starch-based bioplastics, cellulose-based bioplastics, polyhydroxy alkanoate (e.g. PHB, polyhydroxy butyric acid), PLA poly milk acid (e.g. Ecovio®), aliphatic/aromatic copolyester (Ecoflex®, Infinito®). Further bioplastics which may be used according to the present invention are for example lignin-based bioplastics.

Further General Matters

Design of the Applicator

The applicator comprises a shaft with a bristle field applied thereto.

The applicator is assembled from a shaft and a carrier element respectively plate, the shaft may consist of at least one hard and/or one or more soft material components, The bristle field consists of conventional bristle elements (pointed or cylindrical) and/or rubber elastic massaging and/or cleaning and/or application elements and/or injection molded bristle elements, the carrier element is provided with bristle elements and/or further application elements.

In another embodiment, the rubber elastic massaging and/or cleaning and/or application elements and/or injection molded bristle elements may by attached to the shaft instead to the carrier element, preferably by over molding. The carrier element with the bristle bundle is attached to the shaft separately in the described way.

The bristle bundle can comprise one or more different bristle types. These bristle types can be oriented in the width direction one after the other or in the narrow direction one after the other. They can also alternate.

Different regions of the applicator device respectively its bristle field comprise at least one bristle bundle with different properties compared to the other, a different composition and/or a different shape in one and/or more sections of the at least one bristle bundle. The different composition is present in one or more portions of the bristle elements and/or in one or more of the bristle elements and/or in one or more sections of the at least one bristle bundle and/or in different bristle bundles. The different shape is present in one or more portions of the bristle elements and/or in one or more of the bristle elements and/or in one or more sections of the at least one bristle bundle and/or in different bristle bundles comprised in the applicator device.

Production Methods

Injection molding is accomplished with injection molding machines. In the case of multi-component injection molding the materials are connected with each other by means of positive fit and/or material fit and/or adhesive bonding.

In case of a shrink connection with mobility (e.g. in form of a hinge) materials do not bond to one other but form a form closure or positive fit.

Known processes include hot runner, cold runner or co-injection methods.

Depending on the desired product and on the production method, the choice of the injection points is also an important aspect, as regards for example the production efficiency and the avoidance of possible risks of injury (i.e. due to small protrusions).

Preferably the injection points on the shaft and also on the carrier are positioned on outer faces of the respective part which in the assembled state of the applicator do not build part of the outer surface.

Bristling Methods

Preferably, anchorless methods are used in the context of the present invention. Here, the bristle elements are generally not folded. Compared to the bristle elements used in an anchor-punch method, the bristle elements used for anchorless production comprise only half of the length.

Method 1 comprises the following sequence: (1) separating the bristle bundles of optionally pre-rounded bristle elements, optionally combining bristle picks of bristle filaments, optionally forming a profile with the free ends of the bristle elements/the free end of the bristle bundle (2) melting and connecting the bristle element ends and (3) directly overmolding the bristle element ends. In general, the bristle bundles may be combined.

Known procedures include: IMT where the overmolding procedure contains also the injection molding of the grip, as well as IAP (integrated anchorless production) where the bristle elements are at first overmolded with the carrier element and subsequently, the carrier element is overmolded with a grip.

Method 2 comprises the following sequence: (1) injection molding of the carrier element with the through-holes, (2) the bristle elements are provided by separating the bristle bundles of optionally pre-rounded bristle elements, optionally combining bristle picks of bristle filaments, optionally forming a profile with the free ends of the bristle elements/the free end of the bristle bundle and introduced through the carrier element, (3) the respective bristle element ends are melted together on the rear side and also with the carrier element and (4) the bristled carrier element with the separately produced grip is welded by means of ultrasonic welding.

Method 3 comprises the following sequence: (1) the carrier element with blind holes for bristle elements in the head part is injection-molded, (2) the bristle elements are provided in the form of bristle bundles by separating the bristle bundles of optionally pre-rounded bristle elements, optionally combining bristle picks of bristle filaments, optionally forming a profile with the free ends of the bristle elements/the free end of the bristle bundle, (3) the bristle elements are melted bundle-wise and (4) the head portion is heated up to the glass temperature and (5) the bristle elements are introduced into the blind holes and are anchored in the bristle head by means of pressure (the size of the blind holes is reduced by deforming the body such that the bristle elements are anchored).

Applications

Possible applications as brush products generally include body care. This includes cosmetics, generally in the form of brushes at various applicators (e.g. mascara brush, makeup-brush, nail-polish brush, lip gloss applicator or eyebrow brush).

For the field of mouth hygiene interdental cleaners or single-tuft brushes may be provided. Also for the field of medical technique brushes respectively applicators may be provided.

Bristle Fields

Bristle Bundle Parameters

The basic shapes of the bristle field may in general (i.e. the overall impression) be rounded or elongated. Also, the basic shapes of the individual bristle bundles may be round or elongated.

The number of bristle bundles may be one, two, three or more bristle bundles (cf. above with the respective number of recesses/openings in the carrier element). The orientation of the bristle elements/bristle bundles (on the basis of the carrier element) may be straight or angled in one direction or angled against each other. The angle of the bristle bundle on the basis of the carrier element (angle between carrier surface and bristle length axis) is between 50° and 90° preferably 75° and 90°

Regarding the profiles of the bristle bundles (i.e. design of the end face of the free bristle ends) the following applies: in the longitudinal direction (in direction of the length axis of the bristle elements) a steady profile (a wave or a rounding for example in form of a tongue) may be provided. Alternatively (or additionally) a non-steady profile in the form of an angled contour may be provided. There is also the possibility of various bristle bundles which form a continuous contour in the longitudinal direction. In the transverse direction, a steady profile may be provided (for example with a rounding) or an unsteady profile (for example with steps) may be provided. In general, various areas may be created, wherein certain areas surround or enclose other areas.

Regarding the relationship to other bristle bundles, individual bristle bundles may be provided which are not in contact with one another; but also bristle bundles which are in contact with each other or which cross each other or mingle with each other may be provided according to the present invention.

Possible Bristle Bundle Arrangements

There are various bristle bundle arrangements which fall under the scope of the present invention. Exemplary embodiments are briefly described in the following:

"Ring Bundles" are preferably manufactured using the Hot Tufting method. The bristle bundles are continuously formed without interruptions. The design is thus in form of a closed contour. The bristle elements/bristle bundles may be slightly angled or straight (on the basis of the carrier element). Usually, the bristle elements enclose or surround a center point wherein the center point may also comprise bristle bundles (e.g. one or more solitary bristle bundles).

"Concentric Rings" means that various rings are arranged in a concentric manner wherein the individual rings may be designed as described above under "Ring Bundles".

In "Tent- or Tipi-shaped Bundles" the bristle bundles are arranged on a ring or a bristle bundle is formed as a ring. This is achieved by means of a circular bristle bundle or for example by means of multiple angled individual bristle bundles. The bristles are angled (inwardly) in such a way that the tips meet in a point. The application is focused on said one point.

"Pillar Bundles" form, in the side view, also a tent but a longitudinal tent. The bristle bundles are preferably straight on the inwardly angled sides and since they are straight the ends meet and form e.g. a center line. However, the bristle bundles may also not meet at the end such that one bristle bundle abuts the other below the free end line of the other bristle bundle. Thus, the bristle bundles may also form offset lines.

"Double Fan Bundles" may be formed in one or two recesses/openings of the carrier element. In case of one recess/opening there is provided a continuous bristle bundle with a step. If the bristle bundles are provided in two recesses/openings they may be distanced when they stand vertically and if they are angled, they may approach each other or may be formed as the "Pillar Bundles" described above.

"Fan Bundles" define a fan which is substantially in the form of a reversed truncated cone. Various angles of inclination are possible for the bristle elements forming the outer sleeve.

The center portion may be made from different bristle elements as the rest or a further bristle element may protrude from or may be integrated into the structure. The fans formed in this manner may consist of different bristle elements.

The end face may for example be in the form of a truncated cone or may be in the form of an inclined surface with a protruding bristle bundle portion.

"Coat Bundles" may define a simple coat in form of a not fully closed circle. The end profile may for example be chamfered or bevelled. The coat bundles may consist of multiple bristle types.

There may also be provided a simple coat with a standing/straight center bristle bundle. The center bristle bundle may consist of bristle elements, injection molded bristle elements or of a soft material component in form of a rubber elastic massage and cleaning element.

"Tongue Bundles" may not be straight but with a kidney shaped cross-section. Thereby, the cross-sectional shape is adopted to the bristle bundle shape (kidney shape). The end shape may be an inclined surface or else an arch (also two contours in two directions may be provided).

"Multi Tuft Bundles" comprise combinations of multiple bristle bundles. They may have various shapes, e.g. in form of a single tuft bundle or a fan bundle or a tongue bundle or a coat bundle. Also, various steps may be provided in the height profile. Further, various forms of cuts or recesses may be provided between the individual bristle bundles.

Separated symmetrical bristle bundles may be provided for example in form of an inverted tipi-tent shape.

"X-Bundles" for example comprise elongated bristle bundles which cross each other in the side view. Alternatively, the bristle bundles mingle respectively intermingle with each other.

Other bristle bundles may be round and inclined in one direction. If there are for instance multiple circles with inclined bristle elements or bristle bundles not all of the bristle elements or bristle bundles are inclined in the same direction. There is also the possibility that one ring is inclined to the left hand side and the other ring is inclined to the right hand side.

The bristle bundle arrangement may also create a hollow space for an applicator medium so that the applicator medium may be stored there in order to provide a continuous supply. Preferably this is in the form of a long-term supply for a longer application.

Combinations

The bristle bundles shown and described herein may be combined with each other and/or with soft material component elements and/or with injection moulded bristle elements. Generally, the shapes of the bristle bundles may be replaced 1:1 by elements made of soft material component or by injection molded bristle elements.

Last but not least the handle shapes may be adopted to the bristle field, e.g. in form of a kidney-shaped grip portion.

The bristle bundle can build in a front view (in direction to the wide side of the shaft) various topographies composed by the free ends of the bristle elements respectively the bundles.

The topography can be flat, means a rectangular bristle field respectively a bristle bundle with a flat free end will be formed.

Further the free end of the bristle bundle can be in the form of a truncated cone, a cone, a flat geometry with one rounded corner, a half circle (means fully rounded), a wavy chamfer topography, a mandrel, a notch, a furcated topography, a serrated topography, a toothed topography.

The topography in the form of a truncated cone bases on the rectangular bristle field respectively bristle bundle. Thereby the corners of the bristle bundle are cut a as a chamfer. Between the cutted corners there is a flat geometry formed. The transition from one edge to the other edge (on the corner) can be rounded or discontinuous.

Also, the topography in the form of a cone bases on the rectangular bristle field respectively bristle bundle. The cone is a special form of the truncated cone. The cone geometry is set up in a way where one end of the cutted edges meet in a corner. This corner can be rounded or discontinuous. The cone topography also comprises the possibility to form the edges as parts of a wide radius circle that the whole topography gets more round and smooth.

Also, the topography in the form of a flat geometry with one rounded corner bases on the rectangular bristle field respectively bristle bundle. The topography is created on the basis of a rectangular bristle bundle whereby one corner is rounded. The round shape can be just a little rounding of the corner with small radius or it can be created as a big rounding with big radius where this part of the circle starts near one corner of the rectangular shape and continues steady to the edge on the other side. Instead of a circle also an oval geometry can be realized.

The half circle (means fully rounded) topography is a kind of twice the rounded corner topography. The half circle topography is a circle with a radius of half the width of the bristle bundle. Thereby the topography goes steady from left edge to right edge of the bristle bundle. A variant of this geometry is an oval geometry which brings a more flat but still rounded middle section.

The wavy chamfer topography is breaks one corner of the rectangular bristle bundle/bristle field with a continuous steady wavy contour. The higher end of the topography forms a kind of a smooth tip.

The mandrel topography builds a bristle bundle with one symmetrically positioned tip. The edges which continue to the tip can be split to two or more edges. These edges continue form the wides part of the bristle bundle continuously to the tip.

On the basis of the rectangular bristle field/bristle bundle some re-entrant topographies can be formed. For example, in form of a notch. The notch topography has one inclined corner. The furcated topography can have several inclining corners of variable depth, whereby a serrated/toothed topography has a kind of a wavy geometry with various inclining corner of the same depth. Generally inclining topographies can be symmetrically oriented or not. The inclining geometries can have several identical indentations or variable indentations. The variability can be regular or irregular, for example the depth of the indentations can be bigger in the middle, can grow from left to right. The end corners of the indentations can build a curve for example a parable.

The corners of all topography examples can be sharp or rounded. The edges of the examples can be flat or wavy. Of course, it should be considered that the embodiments shown in this application are merely exemplary. Within the scope of the present invention, the individual embodiments and elements of the embodiments may be combined with other embodiments without departing from the scope of the present invention.

The description for the specific figures may of course be transferred to other figures, which comprise the same or similar composition and in which the elements are not described in the same detail.

Further, it is to be noted that the upper side of the carrier element respectively plate is the bristled side and the rear side of the carrier element, respectively plate, is the side which is later on introduced into the shaft.

The embodiments shown in the following figures merely serve as an example. Within the scope of the present invention, individual characteristics and elements of these embodiments may be combined with other embodiments of the present invention.

It shows:

FIG. 1: a three-dimensional view of the shaft;

FIG. 2: a side view of the wide side of the shaft of FIG. 1;

FIG. 3: a side view of the narrow side of the shaft of FIG. 1;

FIG. 4: a plan view along the longitudinal axis of the shaft of FIG. 1;

FIG. 5: a section view of the wide side of the shaft of FIG. 1;

FIG. 6: a section view of the narrow side of the shaft of FIG. 1;

FIG. 7: a cross-section through the shaft through the recesses (notches) of the upper edge;

FIG. 8: a cross-section through the shaft respectively through the recesses (through holes) in the wide side of the shaft of FIG. 1;

FIG. 9: a three-dimensional view of the front side of the carrier element;

FIG. 10: a three-dimensional view of the rear side of the carrier element of FIG. 9;

FIG. 11: a plan view of the front side of the carrier element of FIG. 9;

FIG. 12: a plan view of the rear side of the carrier element of FIG. 9;

FIG. 13: a side view of narrow side of the carrier element of FIG. 9;

FIG. 14: a side view of the wide side of the carrier element of FIG. 9;

FIG. 15: a section view of the wide side of the shaft of FIG. 9;

FIG. 16: a section view of the narrow side of the shaft of FIG. 9;

FIG. 17: a three-dimensional view of the bristled carrier element;

FIG. 18: a section view of the wide side of the bristled carrier element of FIG. 17;

FIG. 19: a section view of the narrow side of the bristled carrier element of FIG. 17;

FIG. 20: a three-dimensional view of the finished applicator device;

FIG. 21: a side view of the narrow side of the finished applicator device of FIG. 20;

FIG. 22: a side view of the wide side of the finished applicator device of FIG. 20;

FIG. 23: a section view of the narrow side of the finished applicator device of FIG. 20;

FIG. 24: a section view of the wide side of the finished applicator device of FIG. 20;

FIG. 25: a plan view of a cross-section through the finished applicator device of FIG. 20 in the area of the recesses (through-holes) in the wide side of the shaft;

FIG. 26: a three-dimensional view of the front side the grid-like structure for the production of the bristled carrier elements;

FIG. 27: a three-dimensional view of the rear side of the grid-like structure of FIG. 26;

FIG. 28: a plan view of the front side of the grid-like structure of FIG. 26;

FIG. 29: a plan view of the rear side of grid-like structure of FIG. 26;

FIG. 30: a section view of the wide side of the grid-like structure of FIG. 26;

FIG. 31: a section view of the narrow side of the grid-like structure cross-section of FIG. 26;

FIG. 32: a three-dimensional view of a bristle field in form of a tent;

FIG. 33: a three-dimensional view of a bristle field in form of a tongue;

FIG. 34*a*: a three-dimensional view of a first pillar bundle;

FIG. 34*b*: side view of the first pillar bundle of FIG. 34*a;*

FIG. 34*c*: a plan view of the carrier element of the first pillar bundle of FIG. 34*a* in the shaft without bristle elements;

FIG. 35*a*: a three-dimensional view of a second pillar bundle;

FIG. 35*b*: side view of the second pillar bundle of FIG. 35*a;*

FIG. 35*c*: a plan view of the carrier element of the second pillar bundle of FIG. 35*a* in the shaft without bristle elements;

FIG. 36*a*: a three-dimensional view of a double fan bundle;

FIG. 36*b*: a side view of a double fan bundle of FIG. 36*a;*

FIG. 36*c*: a plan view of the carrier element of the double fan bundle of FIG. 36*a* in the shaft without bristle elements;

FIG. 37: a three-dimensional view of a first fan bundle;

FIG. 38: a three-dimensional view of a second fan bundle;

FIG. 39: a three-dimensional view of a first coat bundle;

FIG. 40: a three-dimensional view of a second coat bundle;

FIG. 41: a three-dimensional view of a first multi-tuft bundle;

FIG. 42: a three-dimensional view of a second multi-tuft bundle;

FIG. 43: a front view of a first bristle field topography;

FIG. 44: a front view of a second bristle field topography;

FIG. 45: a front view of a third bristle field topography;

FIG. 46: a front view of a fourth bristle field topography;

FIG. 47: a front view of a fifth bristle field topography;

FIG. 48: a front view of a sixth bristle field topography;

FIG. 49: a front view of a seventh bristle field topography;

FIG. 50: a front view of an eighth bristle field topography;

FIG. 51: a front view of a nineth bristle field topography;

FIG. 52: a front view of a tenth bristle field topography;

FIG. 53: a front view of a first combined bristle field;

FIG. 54: a front view of a second combined bristle field;

FIG. 55: a front view of a third combined bristle field;

FIG. 56: a front view of a fourth combined bristle field

FIG. 57: a front view of a fifth combined bristle field;

FIG. 58: a front view of a sixth combined bristle field;

FIG. 59*a*: a front view of a seventh combined bristle field;

FIG. 59*b*: a side view of the seventh combined bristle field of FIG. 59*a;*

FIG. 59*c*: a rear view of the seventh combined bristle field of FIG. 59*a;*

FIG. 60*a*: a front view of an eighth combined bristle field;

FIG. 60*b*: a side view of the eighth combined bristle field of FIG. 60*a;*

FIG. 60*c*: a rear view of the eighth combined bristle field of FIG. 60*a;*

FIG. 61*a*: a front view of a nineth combined bristle field;

FIG. 61*b*: a side view of the nineth combined bristle field of FIG. 61*a;*

FIG. 61*c*: a rear view of the nineth combined bristle field of FIG. 61*a;*

FIG. 62: a three-dimensional view of another finished applicator device according to the invention FIG. 63: a three-dimensional view of parts of an embodiment of an applicator device in an unassembled state;

FIG. 64: a three-dimensional view of the finished applicator device of FIG. 63;

FIG. 65: a three-dimensional view of a further embodiment of a finished applicator device;

FIG. 66: a side view of the applicator device of FIG. 65; and

FIG. 67: a section view of the applicator device of FIG. 65.

FIG. 1 is a three-dimensional view of an embodiment of an inventive shaft 2 protruding from a base element 19. The end of the shaft 2 which is connected to base element 19 is defined as proximal end 3 of shaft 2. The free end of the shaft 2 is defined as distal end 4. On the rear side of the base element 19 a thread 20 is arranged which shall serve as connection means for a grip respectively handle part (not shown). At the free respectively distal end 4 of shaft 2 a receiving opening 7 is provided into which a bristled carrier element shall be introduced. In the upper edge 8 of shaft 2 at the narrow sides 23, recesses 9, preferably in the form of notches, are provided. In the wide sides 22 of the shaft 2, recesses 15, preferably in form of through-holes or slots, are provided which shall act together with corresponding fastening means of a carrier element.

Further, in FIG. 2 the wide side 22 of shaft 2 with the recess 15 and the longitudinal axis X of shaft 2 are illustrated. The width $w_s$ of the shaft 2 ranges from 4 mm to 12 mm, preferably from 5 mm to 9 mm. The length $l_s$ of shaft 2 ranges from 15 mm to 70 mm, preferably from 35 mm to 50 mm. FIG. 3 depicts the narrow side 23 of shaft 2 with a recess 9. The depth $d_s$ of shaft 2 ranges from 2 mm to 6 mm, preferably from 2.5 mm to 5 mm. The base element 19 slightly protrudes over the thread 20 and in order to act as a kind of barrier for fluids respectively medium or to properly close the opening of a handle which will be screwed on the shaft.

In FIG. 4, a plan view onto the distal end 4 of shaft 2 is shown. The receiving opening 7 is surrounded by the upper edge 8 of shaft 2. Inwardly from the upper edge 8, a support collar 21 is depicted which will be described in more detail in FIG. 5. At the narrow sides 23 the recesses 9 are provided in the upper edge 8. The recesses 9 shall serve for accommodating corresponding lateral protrusions of a carrier element.

FIG. 5 is a cross-sectional view according to line V-V in FIG. 4. The receiving opening 7 at the distal end 4 of shaft 2 comprises a depression 26 with a total depth $d_d$ which ranges from 1 mm to 4 mm, preferably from 2.5 mm to 3 mm. The total depth of the depression comprises a first depth $d_{d1}$ and a second depth $d_{d2}$. Depth $d_{d1}$ is measured from the upper edge 8 of shaft 2 to support collar 21 which protrudes from the inner sidewall inwardly into the depression 26, respectively into a hollow space of the depression. Depth $d_{d1}$ ranges from 1.5 mm to 4 mm, preferably from 1.7 mm to 3 mm. Depth $d_{d2}$ is measured from the support collar 21 (i.e. the step in the side wall) to the bottom 31 of the depression 26 and ranges from 0.5 mm to 2.5 mm, preferably from 0.6 mm to 1.5 mm. The recess 15 is preferably arranged centrally within the width of the depression 26. The length $l_{rs}$ of the recess 15 ranges from 2.5 mm to 5 mm, preferably from 3 mm to 4 mm. The support collar 21 comprises a width $w_{sc}$ which ranges from 0.1 mm to 0.5 mm, preferably from 0.15 to 0.35 mm. The inner side walls of the shaft 2 in the area of the depression 26 slightly taper inwardly and comprise a conicity $c_d$ of 0° to 5° preferably of 0.5° to 2°. This applies to the sidewall in the area of depth $d_{d1}$ as well as in the area of depth $d_{d2}$ (cf. also FIG. 6).

FIG. 6 is a cross-sectional view according to line VI-VI in FIG. 4. The notch-like recesses 9 in the upper edge 8 of the shaft 2 are preferably arranged in the narrow sides 23 and comprise a height $h_{ru}$ which ranges from 0.3 mm to 1.2 mm, preferably from 0.4 mm to 0.8 mm. The width $w_{ru}$ of the recesses 9 ranges from 0.4 mm to 2 mm preferably from 0.6 mm to 1.5 mm. The height $h_{rs}$ of the recesses 15 ranges from 0.4 mm to 1.4 mm, preferably from 0, 6 mm to 0, 9 mm (measured on the outside of the shaft). The lower edge of recess 15 lies substantially in the same height as the upper face of support collar 21. The upper edge of recess 15 preferably tapers inwardly with a conicity $c_{rs}$ which ranges from 0° to 30°, preferably from 5° to 25°.

FIG. 7 is a cross-sectional view according to line VII-VII in FIG. 5. In FIG. 7, the width $w_d$ of the depression 26 respectively of the receiving opening 7 is illustrated. The width $w_d$ ranges from 0.5 mm to 3.5 mm, preferably from 1.5 mm to 2.5 mm (i.e. measured in the area of the upper edge 8). Further, the wall thickness $t_{ws}$ of the sidewalls of the shaft 2 is depicted. The wall thickness $t_{ws}$ ranges from 0.2 mm to 1 mm, preferably from 0.3 mm to 0.6 mm. In the area of depth $d_{d2}$, the width $w_d$ is somewhat smaller due to support collar 21 and the wall thickness $t_{ws}$ is a bit bigger due to support collar 21. Apart from this, the wall thickness $t_{ws}$ is uniform in the cross-section on each height. In this figure the recess 9 in the upper edge 8 can be seen, since the other wall parts are cut and hatched in the figure.

FIG. 8 is a cross-sectional view according to line VIII-VIII in FIG. 6. In FIG. 8, the length $l_d$ of the depression 26 respectively the receiving opening 7 is illustrated. The length $l_d$ ranges from 4 mm to 8 mm, preferably from 5.5 mm to 6 mm (i.e. measured in the area of depth $d_{d1}$). In the area of depth $d_{d2}$, the length $l_d$ is somewhat smaller due to support collar 21. In this figure the recess 15 in the distal shaft end 4 can be seen, since the other wall parts are cut and hatched in the figure.

FIG. 9 is a three-dimensional view of an embodiment of an inventive carrier element 5 (unbristled), i.e. from the upper side 27. The carrier element 5 is generally ring-shaped and comprises a central opening 13 which serves for receiving bristle elements respectively bristle bundles. It is noted that the carrier element 5 may also comprise two or more openings for receiving bristle elements respectively bristle bundles. On the narrow sides of the carrier element 5 lateral protrusions 10 protrude outwardly from the carrier element 5. The lateral protrusions 10 result from a separation process out of a grid-like structure which will be described further below. At the bottom of the wide sides of the carrier element 5 fastening means 14 are arranged, which preferably comprise a hook-like or a tongue-like shape and which act together with recesses 15 in the shaft 2, i.e. usually in form of a snap connection.

FIG. 10 is a three-dimensional view of the carrier element 5 from the rear side 28. Here, the hook-like or a tongue-like shape of the fastening means 14 may be seen clearer.

FIG. 11 is a plan view onto the upper side 27 of carrier element 5 with the lateral protrusions 10, the fastening means 14 and the central opening 13. FIG. 12 is a plan view onto the rear side 28 of carrier element 5 with the lateral protrusions 10, the fastening means 14 and the central opening 13. The length $l_{fc}$ of the fastening means 14 of carrier element 5 is depicted. The length $l_{fc}$ ranges from 1 mm to 6 mm, preferably from 2 mm to 4 mm.

FIG. 13 is a side view of carrier element 5 with lateral protrusion 10, and the hook-like or tongue-like fastening means 14. Further, the width $w_c$ of the carrier element 5, the thickness $t_c$ of the carrier element 5 and the height $h_{fc}$ of the fastening means 14 of the carrier element are shown. The width $w_c$ ranges from 1 mm to 5 mm and preferably from 1.5 mm to 3 mm. The thickness $t_c$ ranges from 1 mm to 3.5 mm and preferably from 1.5 mm to 2.5 mm. FIG. 14 is a longitudinal side view of carrier element 5 with fastening means 14 and lateral protrusions 10. Further, the length $l_c$ of carrier element 5 is depicted. The length $l_c$ ranges from 4 mm to 9 mm and preferably from 5 mm to 7 mm.

FIG. 15 is a cross-sectional view according to line XV-XV in FIG. 11. The thickness $t_{pc}$ of the lateral protrusions 10, the conicity $c_{co}$ of the central opening 13 (sidewalls taper slightly inwards), the length $l_{co}$ of the central opening 13 and the wall thickness $t_{wc}$ of the carrier element 5 are illustrated. The thickness $t_{pc}$ of the lateral protrusions ranges from 0.3 mm to 1.2 mm and preferably from 0.5 mm to 0.8 mm. The conicity $c_{co}$ of the central opening ranges from 1° to 3° and preferably from of 1.50° to 2.5°. The length $l_{co}$ of the central opening 13 ranges from 3 mm to 8 mm and preferably from 4.5 mm to 6 mm. The wall thickness $t_{wc}$ of the side walls 33 of the carrier element 5 (i.e. without lateral protrusions 10) ranges from 0.3 mm to 1 mm and preferably from 0.4 mm to 0.8 mm.

FIG. 16 is a cross-sectional view according to line XVI-XVI in FIG. 11. The width $w_{co}$ of the central opening 13 of the carrier element 5 and again the conicity $c_{co}$ of the central opening are depicted. The width $w_{co}$ of the central opening 13 ranges from 0.5 mm to 2 mm and preferably from 0.6 mm to 1 mm. The shape of the fastening means 14 generally corresponds to the shape of the recesses 15 in the shaft 2, i.e. in particular the hook-like or tongue-like embodiments comprise an inclination which optimally correspond to conicity $c_{rs}$ of the recesses 15 in order to achieve a strong snap connection.

FIG. 17 illustrates a three-dimensional view of a bristled carrier element 5 with lateral protrusions 10, fastening means 14 and a melt carpet 30. The melt carpet results from e.g. a melting operation which is carried out at the mounting ends 12 of the bristle elements 6 after the bristle elements 6 have been introduced into the carrier element 5. Opposite from the mounting ends 12 of the bristle elements 6, the free ends 11 of the bristle elements 6 are located. In the embodiment shown, the bristle elements 6 respectively the bristle field comprises a rounded edge 29. In this manner, better brushing characteristics may be achieved in certain applications. The bristle field may generally consist of one bristle bundle or of two or more bristle bundles.

FIG. 18 is a cross-sectional front view of the bristled carrier element of FIG. 17. The melt carpet does preferably not protrude over the outer sidewalls 33 of the carrier element 5. FIG. 19 is a cross-sectional side view of the bristled carrier element of FIG. 17. and depicts the thickness $t_{mc}$ of the melt carpet 30. The thickness $t_{mc}$ of the melt carpet 30 ranges from 0.1 mm to 0.5 mm, preferably between 0.15 mm and 0.3 mm. Before the melting operation, the bristle elements 6 protrude over the rear side 28 of the carrier element 5 with a length ranging from 0.2 mm to 0.8 mm and preferably from 0.3 mm to 0.6 mm.

FIGS. 20 to 22 illustrate an inventive applicator device 1, i.e. the bristled carrier element 5 has been introduced into the shaft 2. The bristle elements 6 respectively the bristle field with the rounded edge 29 protrudes from the distal end 4 of the shaft 2. At the proximal end 3 of the shaft 2, the base element 19 and the thread 20 are arranged. In the side view of FIG. 21, a recess 9 in the upper edge 8 of narrow side 23 is shown in which the protrusion 10 of the carrier element 5 is arranged. In the front view of FIG. 22, a recess 15 in the wide side 22 of the shaft 2 is shown into which a fastening means 14 of the carrier element 5 engages (i.e. preferably in the form of a snap connection).

FIG. 23 is a cross-sectional view on the narrow side 23 of an inventive applicator device 1 (i.e. with a bristled carrier element 5 inserted) as shown in FIG. 20 to 22, especially with regard to the region of the distal shaft end 4. In particular, the engagement of the hook-like or tongue-like fastening means 14 of carrier element 5 with the corresponding (i.e. angled respectively inwardly tapering) recesses 15. The melt carpet 30 does not touch the bottom 31 of depression 26. In a preferred embodiment of the present invention support elements or pins for the melt carpet 30 may be arranged at the bottom 31 of depression 26 (not shown here).

FIG. 24 is a cross-sectional view on the wide side 22 of an inventive applicator device 1 (i.e. with a bristled carrier element 5 inserted) as shown in FIG. 20 to 22, especially with regard to the region of the distal shaft end 4. In particular, the engagement of the lateral protrusions 10 of the carrier element 5 into the recesses 9 in the upper edge 8 of the shaft 2 is shown.

FIG. 25 is a cross-sectional view according to line A-A in FIG. 23 and depicts the fastening means 14 of the carrier element 5 within the recesses 15 of shaft 2. The bristle elements 6 fill out the central opening 13 of the carrier element 5 completely. The carrier element 5 abuts at the inner sidewalls of the depression 26, i.e. in the area of depth $d_{d1}$ (cf. FIGS. 5 and 6).

FIG. 26 is a three-dimensional view on the upper side of a grid-like structure 17 which has been manufactured by injection molding. Within the frame 18 of the grid-like structure 17 multiple carrier elements 5 (in this embodiment sixteen) are pairwise connected (i.e. horizontally). In other words, two side-by-side arranged carrier elements 5 are respectively connected to the frame 18 and to one another via the (unseparated) lateral protrusion 10 (connection webs). This results in the following horizontal sequence: frame 18—lateral protrusion/connection web 10—carrier element 5—lateral protrusion/connection web 10—carrier element 5—lateral/connection web protrusion 10—frame 18 (also visible in FIG. 31). Vertical connections (additionally or exclusively) are generally also possible. FIG. 27 illustrates the rear side of the grid-like structure 17 with the rear side 28 of the carrier elements 5 and the (inverted) fastening means 14. The lateral protrusions respectively connection webs 10 are not visible since they are only arranged in the upper region of the carrier element 5.

FIG. 28 provides a plan view on the upper side of a grid-like structure 17 with the frame 18 and the carrier elements 5 with the fastening means 14 and the (unseparated) lateral protrusions respectively connection webs 10. Further, the width $w_{gs}$ of the grid-like structure 17 and the length $l_{gs}$ of the grid-like structure 17 are depicted. The width $w_{gs}$ of the grid-like structure ranges from 10 mm to 30 mm and preferably from 15 mm to 25 mm. The length $l_{gs}$ of the grid-like structure ranges from 20 mm to 40 mm and preferably from 25 mm to 30 mm. FIG. 29 provides a plan view on the rear side of a grid-like structure 17 with the frame 18 and the carrier elements 5 with the fastening means 14 and the (unseparated) lateral protrusions respectively connection webs 10. The frame 18 comprises a step-like recess 25 which provides for better stability and processing characteristics.

FIG. 30 is a cross-sectional view according to line B-B in FIG. 28 and depicts the frame 18 with the step-like recess 25 and the narrow sides of carrier elements 5 with the fastening means 14 protruding from the side walls of the carrier element (i.e. behind the section plane). Further, the lateral protrusions 10 respectively connection webs are shown, i.e. the "inner" lateral protrusions 10 respectively connection webs which connect the neighboring carrier elements 5. FIG. 31 is a cross-sectional view according to line C-C in FIG. 28 and depicts the frame 18 with the step-like recesses 25 and the inner side faces of carrier elements 5 (i.e. within central opening 13). Between the frame 18 and the two carrier elements 5 and between the two carrier elements 5 a predetermined breaking point 32 is provided. The predetermined breaking point 32 results from the fact that the lateral protrusions respectively connection webs 10 have a smaller thickness (i.e. $t_{pc}$, cf. FIG. 15) than the frame 18 (respectively the upper portion of the recessed frame to which the lateral protrusions 10 respectively connection webs are connected) and the side walls 33 of the carrier elements 5. Since the lateral protrusions respectively connection webs 10 are flush with upper surface of the grid-like structure 17 a small gap is created below the unseparated lateral protrusions respectively connection webs 10 which defines the predetermined breaking point 32. The thickness of the frame 18 substantially corresponds to the thickness of the carrier element $t_c$ (cf. FIG. 13) respectively of the side walls 33 of the carrier element 5.

In the following, various inventive bristle field designs are shown which all have advantageous effects for certain applications. The bristle fields may consist of one or more bristle bundles and the bristle bundles may be fixed in one or more opening of the carrier element. The carrier elements 5 and the shafts 2 may be adopted in their shape such that they correspond to the respective bristle field.

FIG. 32 shows a tent- or tipi-like bristle field which consists of four bristle bundles 6' which are inclined at an angle towards each other and meet with their tips. The tent- or tipi-shaped bristle bundles 6' may also be arranged on a ring or a bristle bundle may be formed as a ring. This is achieved by means of a circular bristle bundle or for example by means of multiple angled individual bristle bundles. The bristle bundles 6' are angled (inwardly) in such a way that the tips meet in a point. The application is thus focused on said one point.

In FIG. 33 a tongue-shaped bristle field is illustrated. The bristle field in this embodiment consists of three bristle bundles 6' which define a tongue-shaped curvature of the bristle field. Generally, such bristle bundles or bristle fields are usually not straight but with a substantially kidney-shaped cross-section. Thereby, the cross-sectional shape is adopted to the bristle bundle shape (kidney shape). The end shape may be an inclined surface or else an arch (also two contours in two directions are conceivable). The tree bristle bundles 6' respectively its bristle elements can also be of various bristle types.

In FIGS. 34*a*-34*c* a pillar bundle is depicted. The bristle field in this embodiment consists of two bristle bundles 6' with chamfered tips which are inclined at an angle towards each other and meet with their tips. In this manner a roof/tent-shaped application end is provided. In other words, pillar bundles form, in the side view, also a tent but a longitudinal tent. The bristle bundles are preferably straight on the inwardly angled sides and since they are straight the ends meet and form e.g. a center line. However, the bristle bundles may also not meet at the end such that one bristle bundle abuts the other below the free end line of the other bristle bundle. Thus, the bristle bundles may also form offset end lines, as shown in FIGS. 35*a*-35*c*. The shown bristle bundles 6' are formed in two recesses/openings 13' of the carrier element 5, respectively.

In FIGS. 36*a*-36*c* a double fan bundle is shown. The bristle field in this embodiment consists of two curved bristle bundles 6' with offset end faces which may be slightly chamfered. The bristle bundles 6' are formed in one recess of the carrier element, fitting snugly together and forming a step in the side view. Generally, double fan bundles may be formed in one or two recesses/openings of the carrier element. In case of one recess/opening 13 there is provided a continuous bristle bundle with a step, as shown. If the bristle bundles are provided in two recesses/openings they may be distanced when they stand vertically and if they are angled, they may approach each other or may be formed similar to the pillar bundles. The bristle bundles 6' respectively its bristle elements can also be of various bristle types.

FIGS. 37 and 38 illustrate two embodiments of a fan bundle. The bristle bundles 6' define a fan which may be in the form of a reversed truncated cone, as for example shown in FIG. 37. Various angles of inclination are possible for the bristle elements forming the outer sleeve. The center portion may be made from different bristle type as the rest or a further bristle type may protrude from or may be integrated into the structure. The fans formed in this manner may consist of different bristle elements. The end face may also form of an inclined surface with a protruding central bristle bundle portion, as shown in FIG. 38.

FIGS. 39 and 40 illustrate two embodiments of a coat bundle. The bristle bundles 6' define a sheath- or coat-like bristle field which may (at least partially) enclose a hollow space (FIG. 39) or which may enclose a solitary center bristle bundle 6' (FIG. 40). Usually, the coat bundles are in form of a not a fully closed circle respectively sheath. The end profile of the bristle bundles 6' may also be chamfered. The coat bundles may consist of multiple bristle types. The center bristle bundle may e.g. consist of conventional bristle elements, injection molded bristle elements or of a rubber elastic massage and cleaning element (of soft material component).

FIGS. 41 and 42 illustrate two embodiments of a multituft bundle. The bristle bundles 6' shown in FIG. 41 form three separate standing fans. Two fans similar to the fan in FIG. 36*a* without step with a smaller cylindrical or oval bristle bundle 6' in the front portion. The bristle field thus forms two steps. Each single bristle bundle 6' is at its height.

Four separated symmetrical bristle bundles 6' are provided in form of an inverted tipi-tent shape according to FIG. 42. The end portions of the bristle bundles 6' may be flat or chamfered, respectively. The bristle bundles may be arranged in one, two, three, four or more recesses/openings of the carrier element 5. Multituft bundles generally comprise combinations of various bristle bundles. They may have diverse shapes, e.g. in form of a single tuft bundle or a fan bundle or a tongue bundle or a coat bundle or combinations thereof. Also, various numbers and sorts of steps may be provided in the height profile. Further, various forms of cuts or recesses may be provided between individual bristle bundles.

Still further inventive bristle field designs are depicted in the following figures which provide front views of the wide sides 22 of shafts 2 with introduced carrier elements, i.e. the fastening means 14 being engaged in the recesses 15. The bristle fields may consist of one or more bristle bundles 6' and the bristle bundles 6' may be fixed in one or more opening(s) of the carrier element. Also here, the carrier elements 5 and the shafts 2 could be adopted in their shape such that they correspond to the respective bristle field. All of the shown bristle field designs have an advantageous effect for specific applications.

Figure 53:
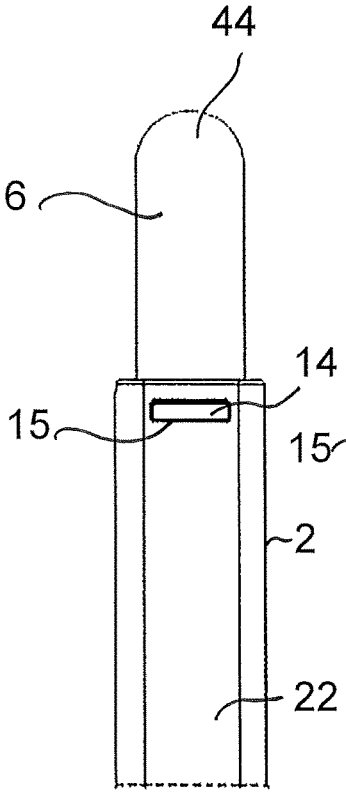
FIG. 53 shows a substantially rectangular bristle field with a (fully) rounded-off end portion 44 comprising one bristle elements 6 of a first bristle type.
Figure 54:
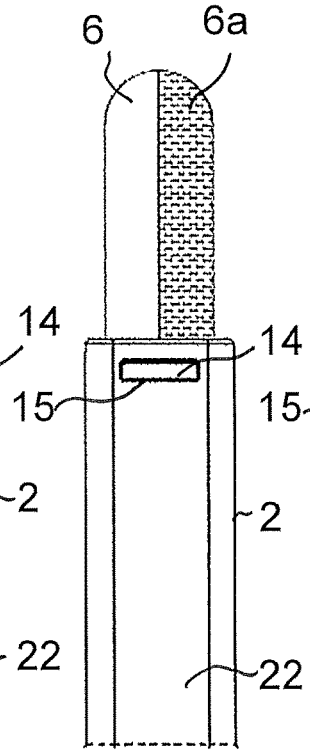
FIG. 54 shows a bristle field with a shape as shown in FIG. 53 but comprising bristle elements 6 of a first bristle type (left half) and of bristle elements 6*a* of a second bristle type (right half).
Figure 55:
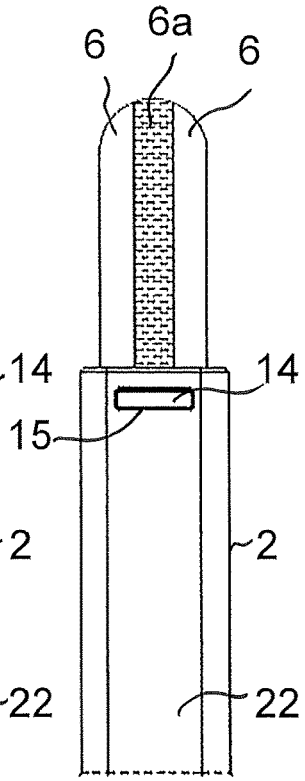

FIG. 55 shows a bristle field with a shape as shown in FIG. 53 but comprising bristle elements 6 of a first bristle type and of bristle elements 6*a* a second bristle type, wherein bristle elements 6*a* of the second bristle type are arranged in the center of the bristle field and the bristle elements 6 of the first bristle type are arranged at the left side and at the right side. Each bristle type section approximately comprises ⅓ of the bristle field.

Figure 56:
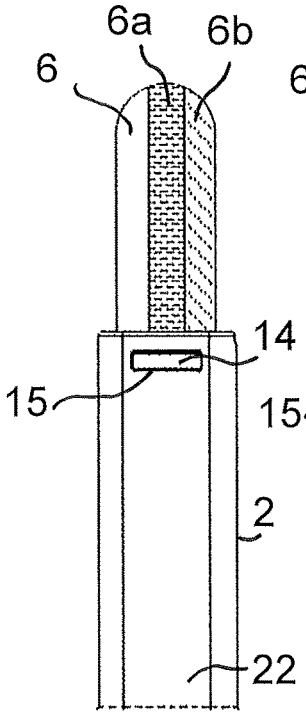
Figure 57:
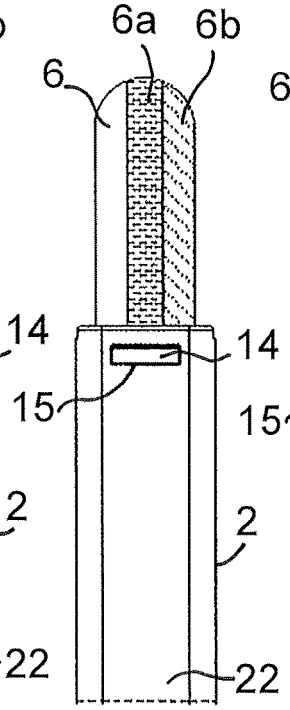

FIGS. 56 and 57 show a bristle field with a shape as shown in FIG. 53 but comprising bristle elements 6 of a first bristle type, bristle elements 6*a* of a second bristle type and bristle elements 6*b* of a third bristle type, wherein bristle elements 6*a* of the second bristle type are arranged in the center of the bristle field and the bristle elements 6 of the first bristle type are arranged at the left side and the bristle elements 6*b* of the third bristle type are arranged at the right side. Each type of bristle elements 6, 6*a*, 6*b* approximately comprise ⅓ of the bristle field and may generally be in any position (i.e. left, center or right).

Figure 58:
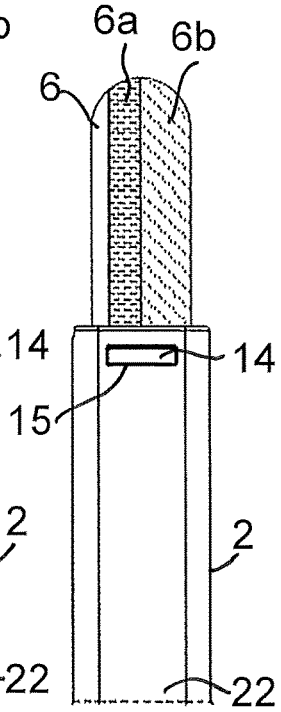

FIG. 58 shows a bristle field with a shape as shown in FIG. 53 but comprising bristle elements 6 of a first bristle type, bristle elements 6*a* of a second bristle type and bristle elements 6*b* a third bristle type, wherein bristle elements 6*b* of the third bristle type form the right half of the bristle field and the bristle elements 6 of the first and bristle elements 6*a* of the second bristle type together form the left half of the bristle field, wherein the bristle elements 6*a* of the second bristle type are located adjacent the bristle elements 6*b* of the third bristle type. The bristle elements 6*b* of the third bristle type approximately comprises 50% of the bristle field, the bristle elements 6*a* of the second bristle type approximately comprises 30% of the bristle field and the bristle elements 6 of the first bristle type approximately comprises 20% of the bristle field. Generally, each group of bristle elements of bristle type 6, 6*a*, 6b may be in any position (i.e. left, center or right) with the respective proportion.

Figures 59A, 59B, 59C:
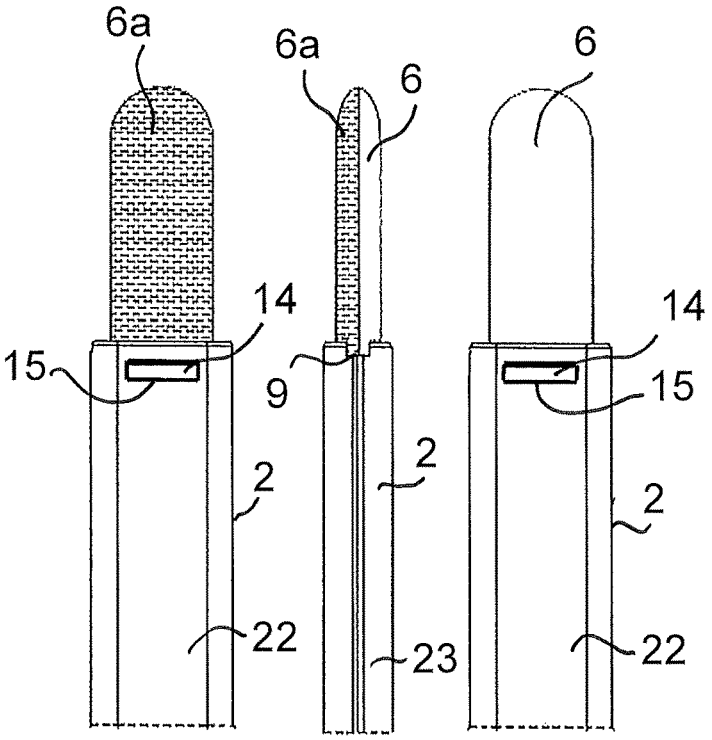

FIGS. 59*a*-59*c* illustrate a further bristle field design which comprises bristle elements 6*a* of the second bristle type on the front side and bristle elements 6 of the first bristle type on the rear side. The side view of FIG. 59*b* shows a tampon-shape with 50% bristle elements 6*a* of the second bristle type and 50% bristle elements 6 of the first bristle type. In the front view, the shape of the bristle field corresponds to FIG. 53.

Figures 60A, 60B, 60C:
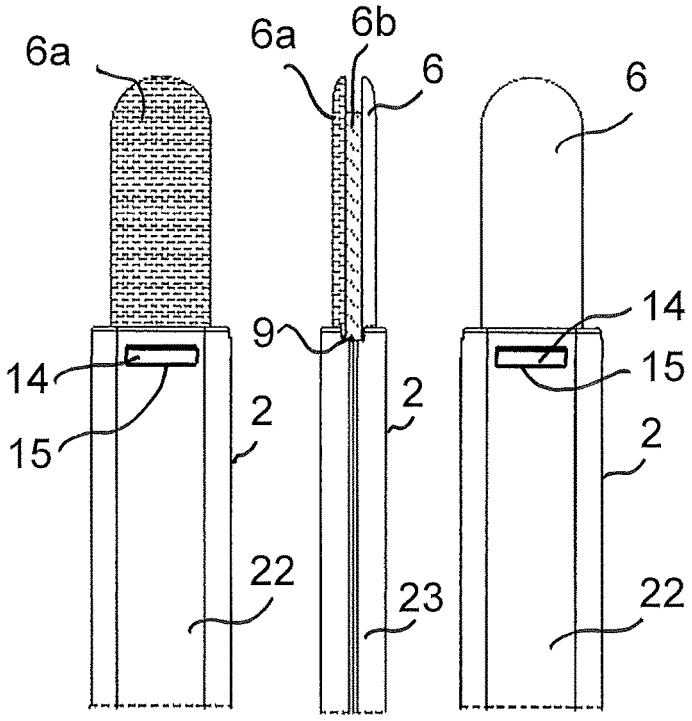

FIGS. 60*a*-60*c* illustrate a bristle field design similar to FIG. 59*a*-FIG. 59*c* which comprises bristle elements 6*a* of the second bristles type on the front side and bristle elements 6 of the first bristle type on the rear side. However, a layer of bristle elements 6*b* of the third bristle type 6*b* is arranged sandwich-like between the bristle elements of the first and second bristles type 6, 6*a*. Bristle elements 6*b* of the third bristles type are somewhat shorter arranged than the bristle elements of the two other bristle types 6, 6*a*. Thus, in the side view of FIG. 60*b* the tampon-shape comprises a gap in the tip portion, i.e. between the higher standing end portions of the bristle elements of the first and second bristles type 6, 6*a*. Of course, each bristle type can be arranged in any position, as desired.

Figures 61A, 61B, 61C:
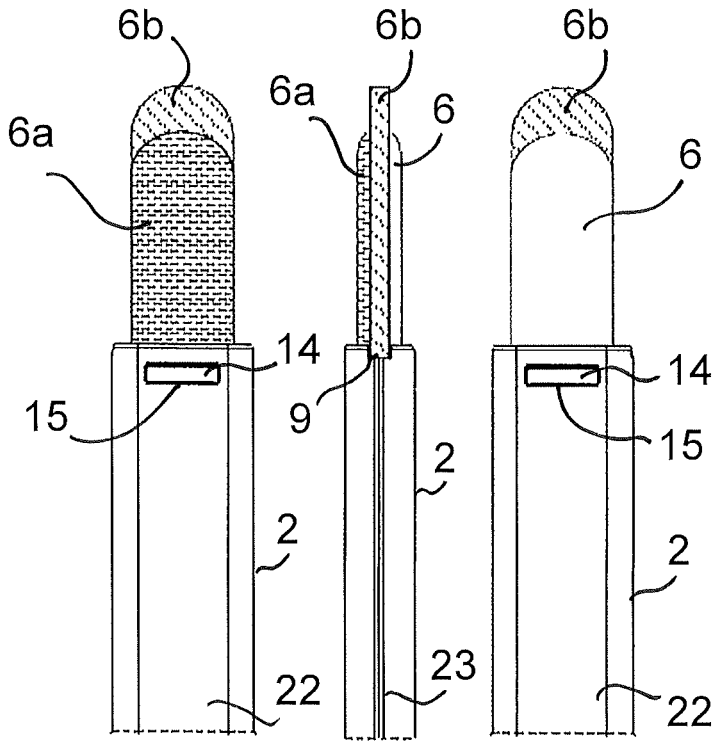

FIGS. 61*a*-61*c* illustrate a bristle field design similar to FIG. 60*a*-FIG. 60*c* which comprises bristle elements 6*a* of the second bristle type on the front side, bristle elements 6 of the first bristle type 6 on the rear side and a layer of bristle elements 6*b* of the third bristle type is arranged sandwich-like between the bristle elements of the first and second bristle type 6, 6*a*. Here, the layer of bristle elements 6*b* of the third bristles type is somewhat longer than the bristle elements of the two other bristle types 6, 6*a*. Thus, in the side view of FIG. 60*b* the tampon-shape comprises a central protrusion in the tip portion of the bristle elements 6*b* of the third bristle type, i.e. between the lower standing end portions of bristle elements of the first and second bristles type 6, 6*a*. Of course, each bristle type can be arranged in any position, as desired.

Figure 62:
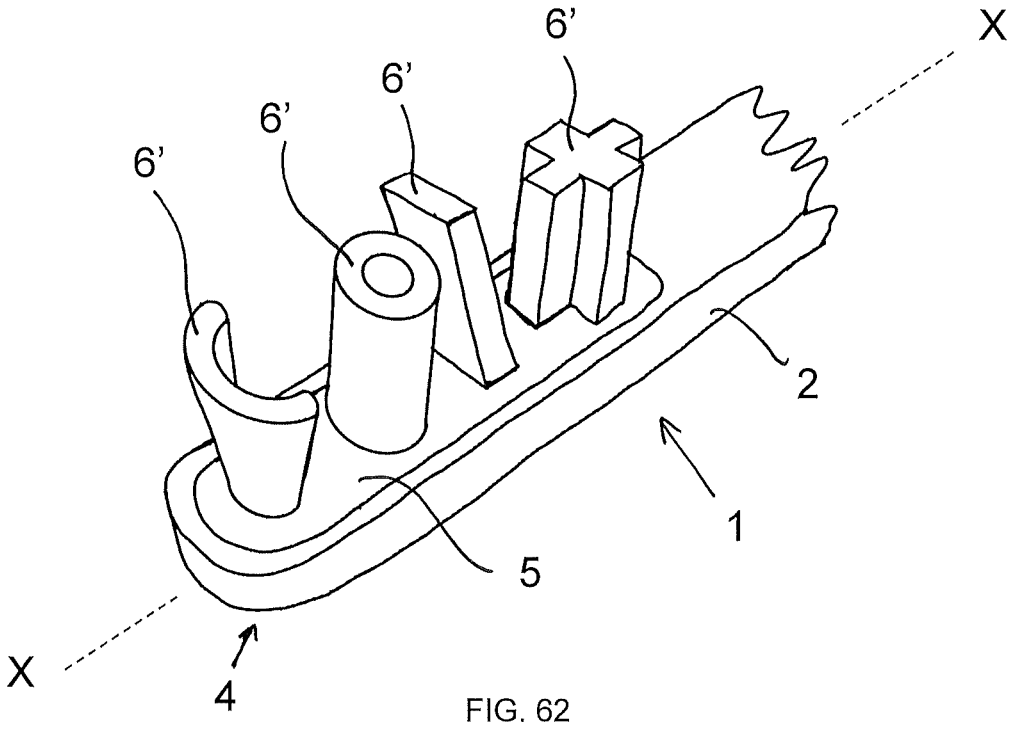

FIG. 62 illustrates another finished inventive applicator device 1 according to the present invention. The bristled carrier element 5 has been introduced into the shaft 2 with an angle of about 90° to the longitudinal axis X. The bristle bundles 6' respectively the bristle field protrudes from the distal end 4 of the shaft 2, around 90° to the longitudinal axis X. Various types of bristle bundles 6' are shown.

The width of the shaft 2 at the position of the bristle bundles 6' is between 3 mm and 7 mm preferably between 3.5 and 5 mm. The length of the carrier element 5 is between 10 mm and 30 mm preferably between 15 mm and 25 mm. The recess in the shaft 2 for receiving the fastening means of the carrier element 5 has preferably the length dimension parallel to the longitudinal axis X.

Examples for bristle types which may be applied in the context of the present invention are described above in the general description.

Figure 63:
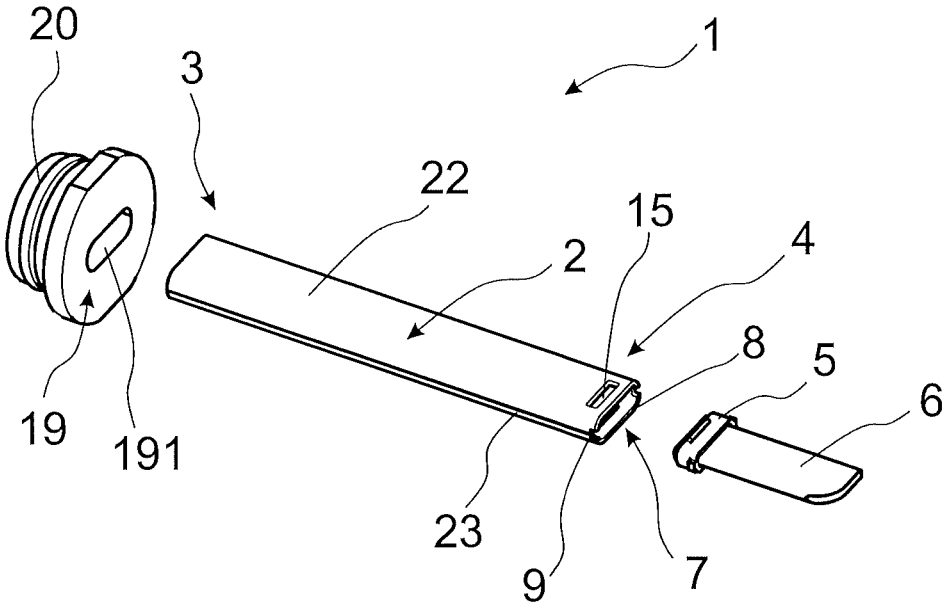

FIG. 63 is a three-dimensional view of parts of an embodiment of an applicator device 1 in an unassembled state. The base element 19 and the shaft 2 are manufactured as separate parts, the bristled carrier element 5 is also separately manufactured and shown separately.

The carrier element 5 is manufactured as described above. The shaft 2 and the base element 19 are manufactured separately in an injection molding process. The shaft 2 may be further processed after molding, for example by a printing process, as described above.

After the further processing of the shaft 2, the proximal end 3 of the shaft 2 is connected to the base element 19 by inserting a proximal end portion of the shaft 2 into a recess 191 of the base element 19. The recess 191 has a cross-section corresponding to the shape of the shaft 2 such that the shaft 2 may be connected with the base element 19 in a form-fit manner. The free end of the shaft 2 is defined as distal end 4. On the rear side of the base element 19, a thread 20 or another fastening means is arranged which shall serve as connection means for a grip respectively handle part (not shown). At the free respectively distal end 4 of shaft 2, a receiving opening 7 is provided into which a bristled carrier element 5 shall be introduced. In the upper edge 8 of shaft 2 at the narrow sides 23, recesses 9, preferably in the form of notches, are provided. In the wide sides 22 of the shaft 2, recesses 15, preferably in form of through-holes or slots, are provided which shall act together with corresponding fastening means of a carrier element 5.

Figure 1:
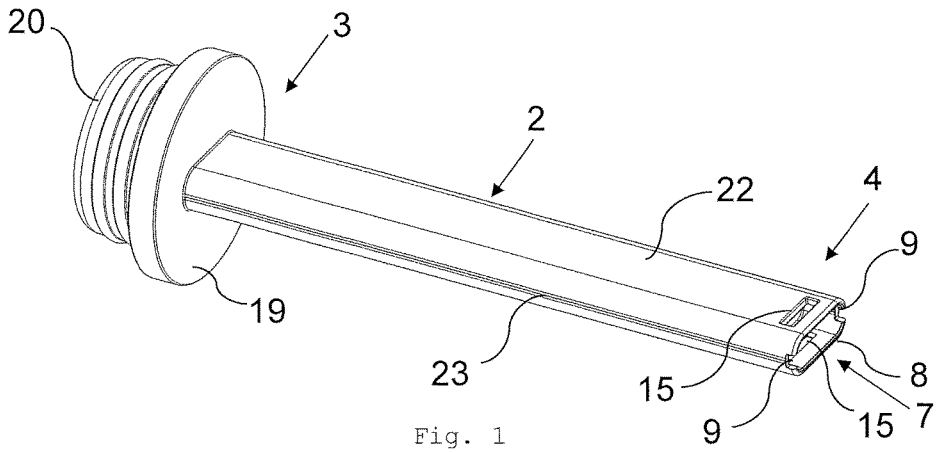
Figure 2:
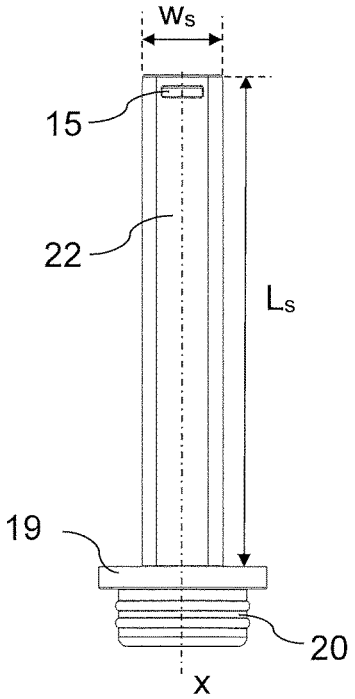
Figure 3:
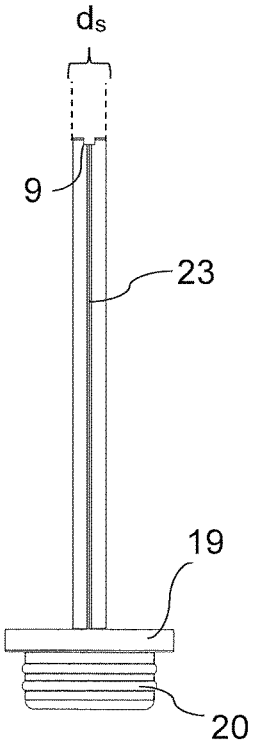
Figure 4:
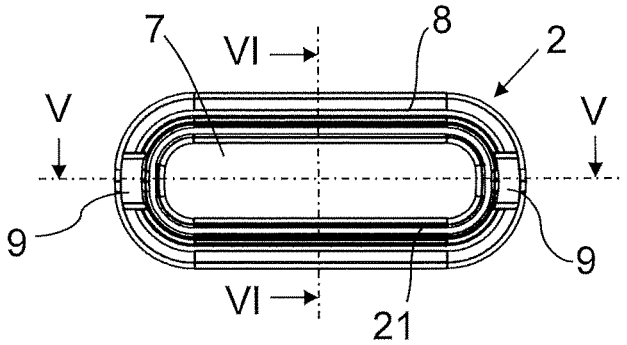
Figure 5:
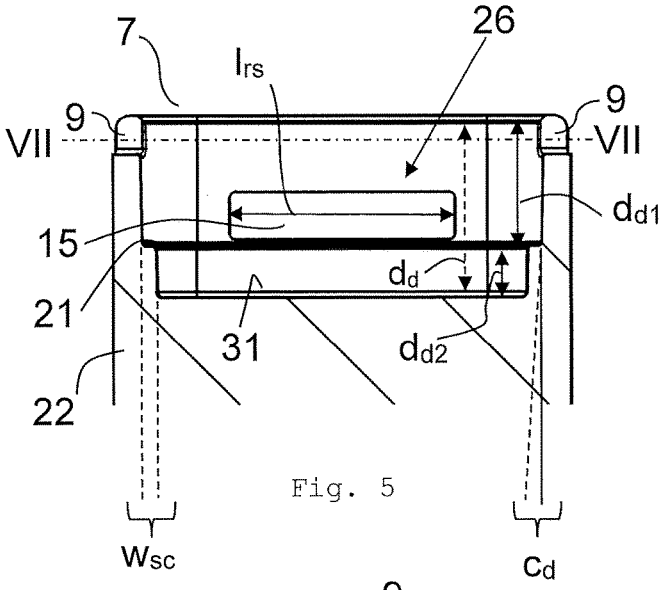
Figure 6:
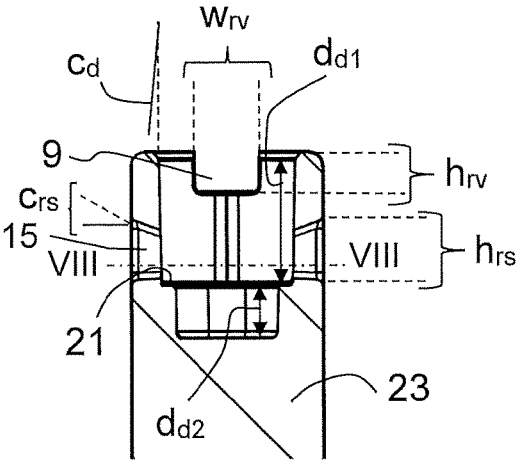
Figure 7:
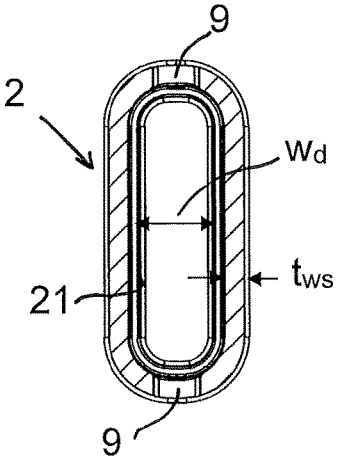
Figure 8:
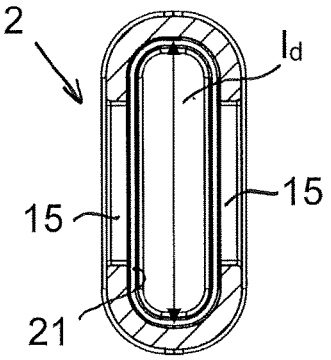
Figure 9:
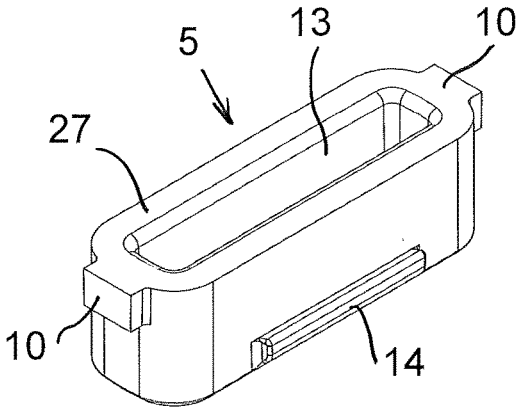
Figure 10:
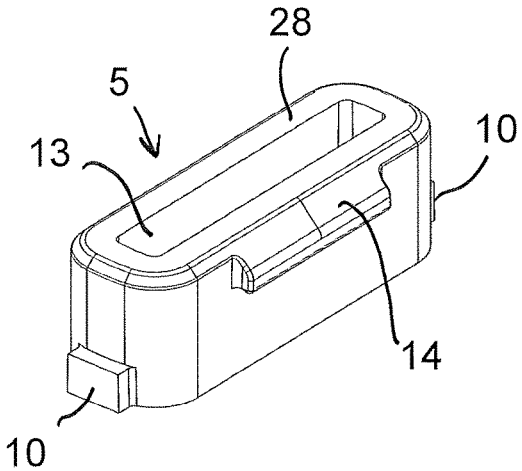
Figure 11:
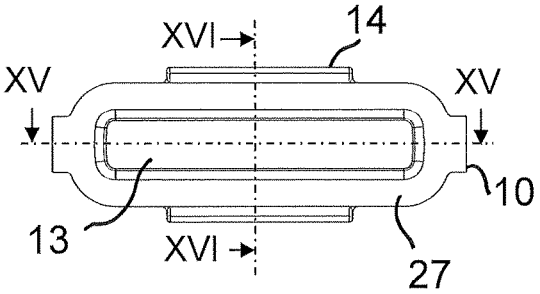
Figure 12:
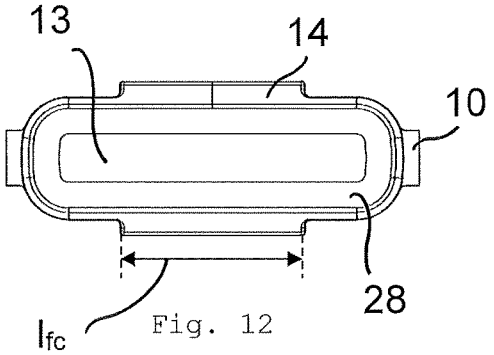
Figure 13:
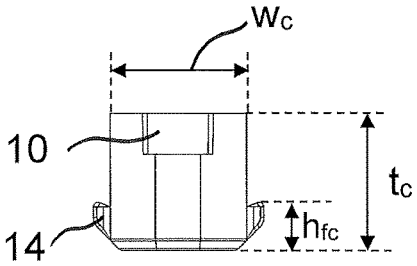
Figure 14:
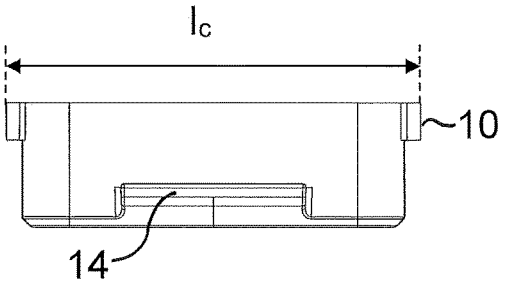
Figure 15:
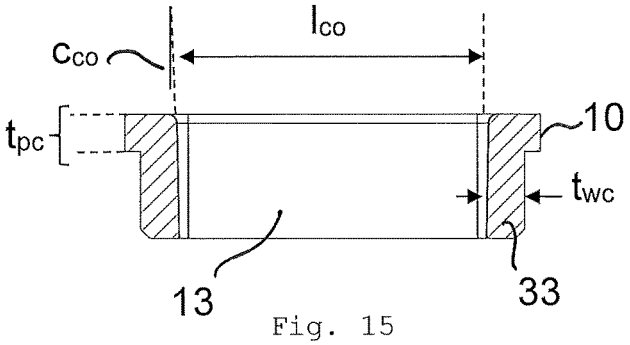
Figure 16:
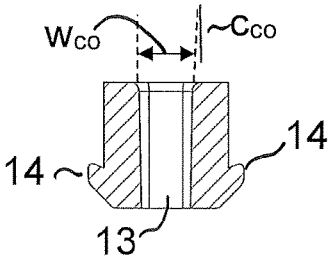
Figure 17:
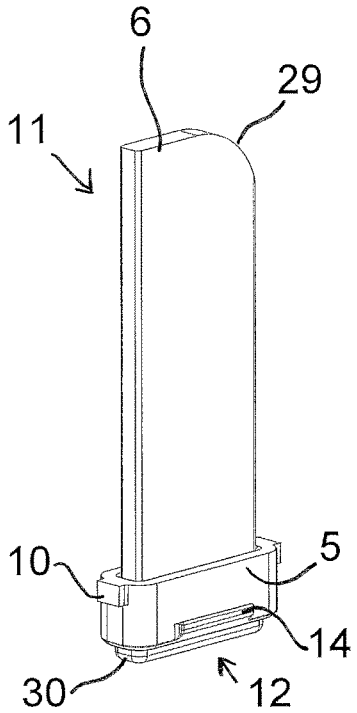
Figure 18:
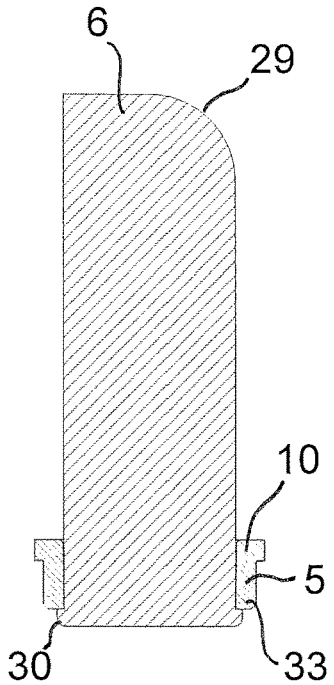
Figure 19:
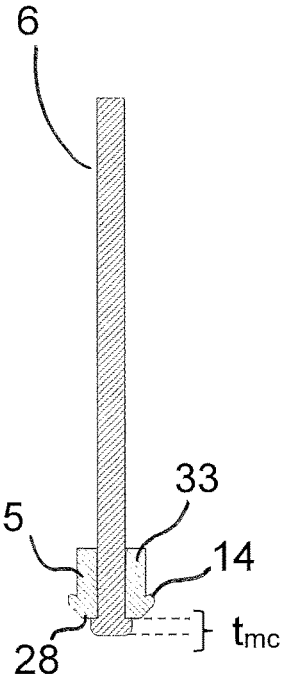
Figure 20:
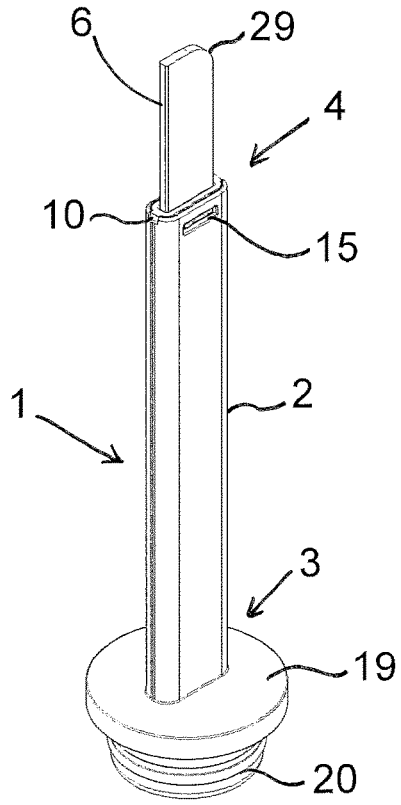
Figure 21:
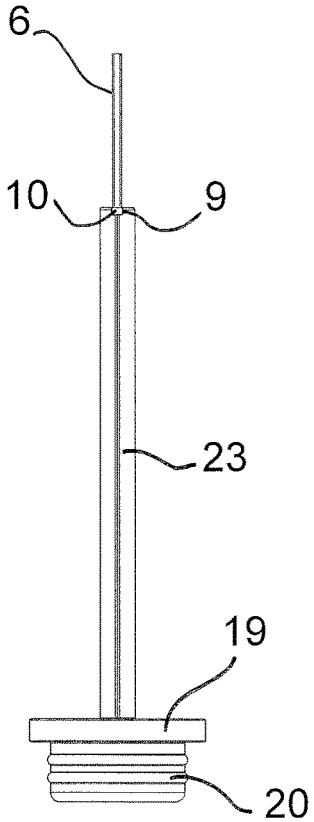
Figure 22:
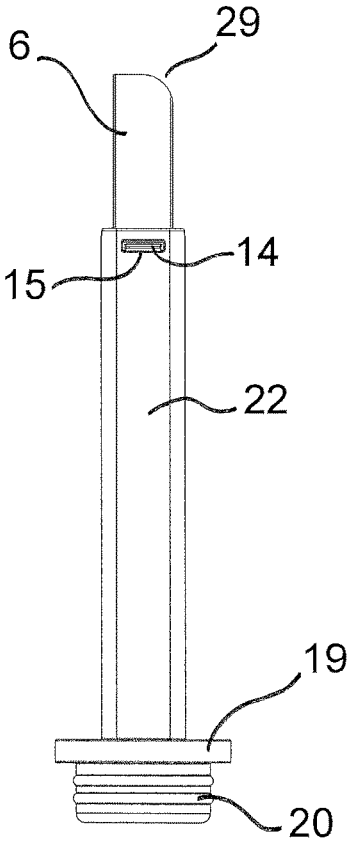
Figure 23:
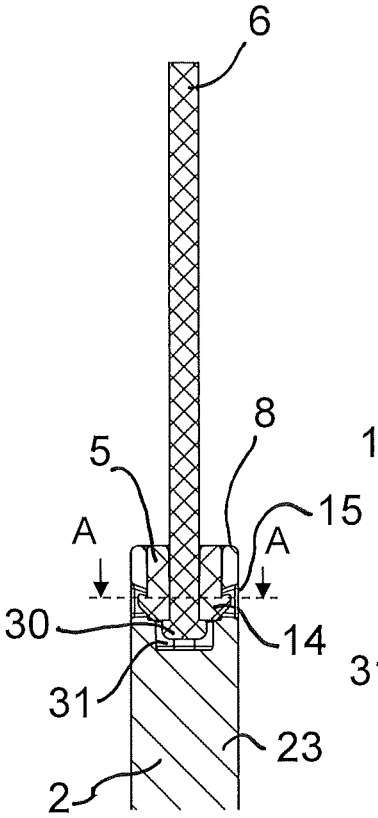
Figure 24:
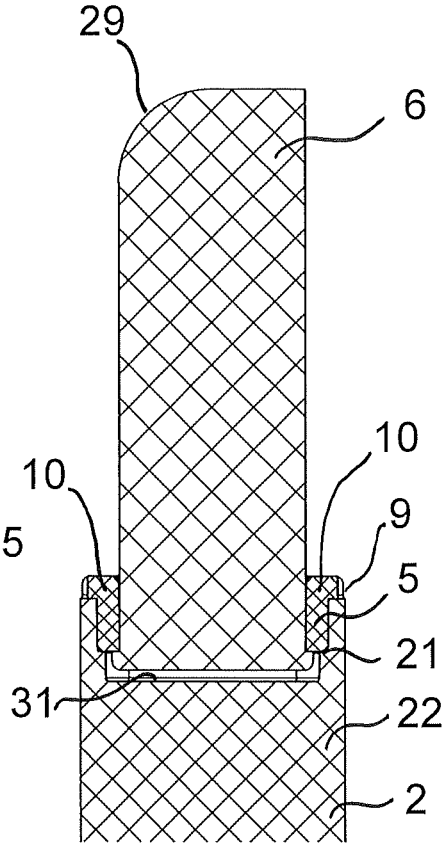
Figure 25:
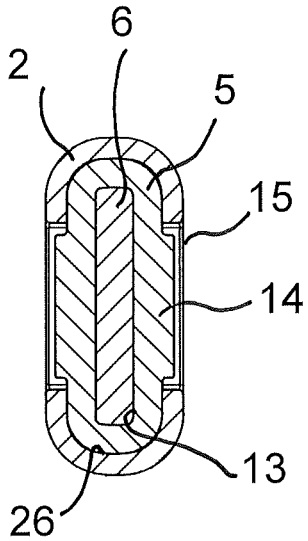
Figure 26:
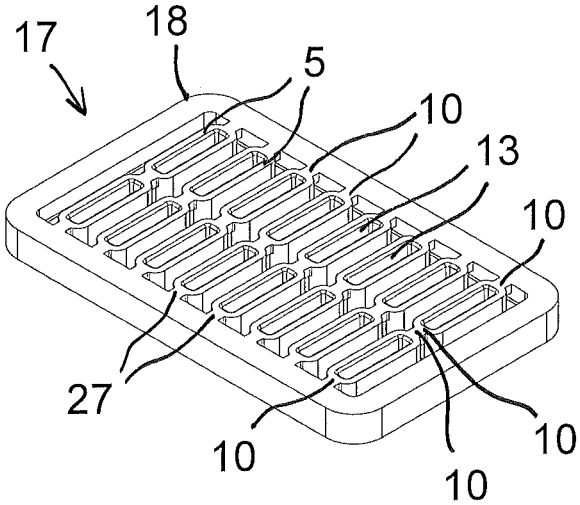
Figure 27:
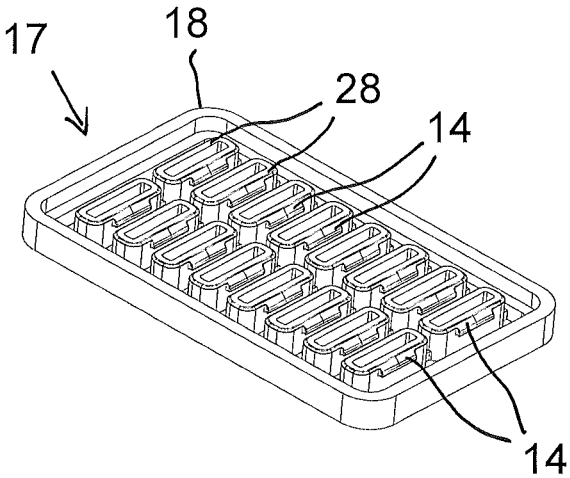
Figure 28:
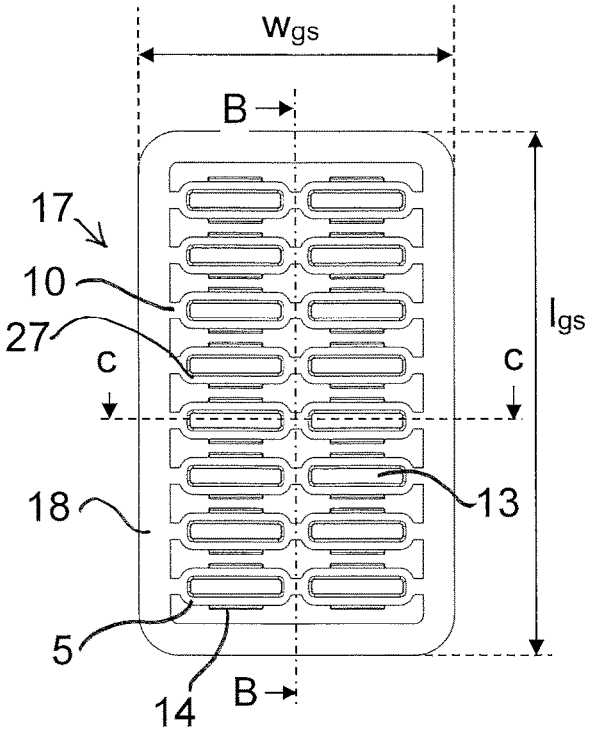
Figure 29:
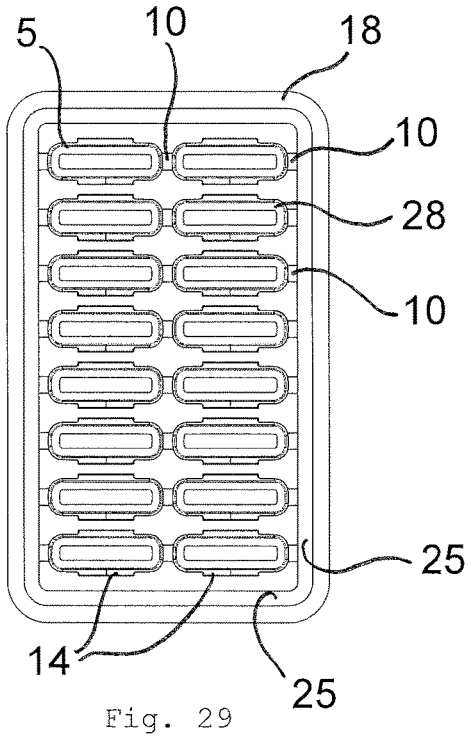
Figure 30:
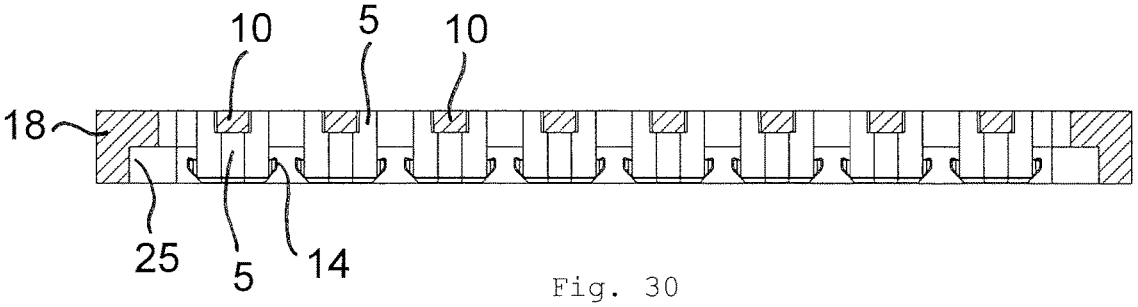
Figure 31:
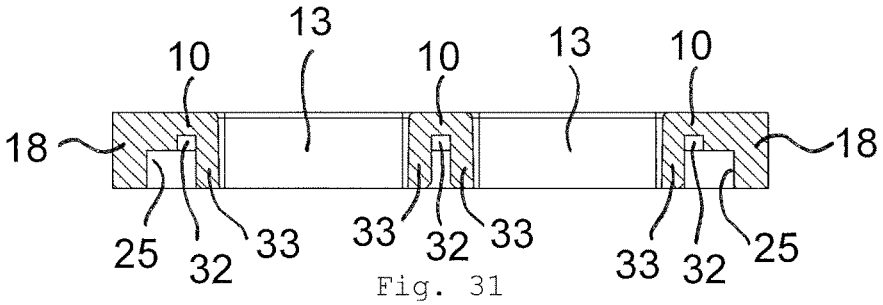
Figure 64:
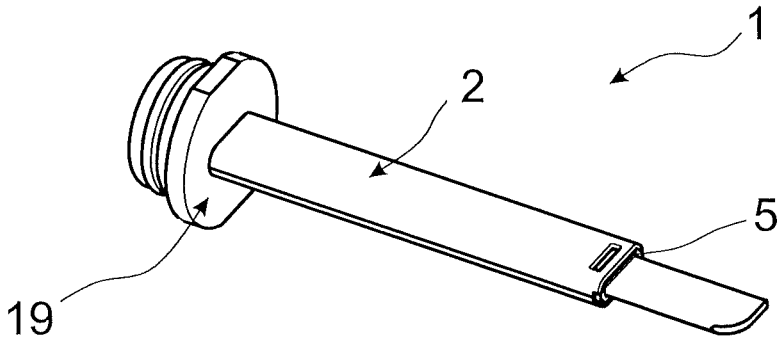

In FIG. 64 the finished applicator device 1 of FIG. 63 is shown. The three parts, base element 19, shaft 2 and bristled carrier element 5, are assembled and build the finished applicator similar to the one shown in FIG. 20.

Figure 32:
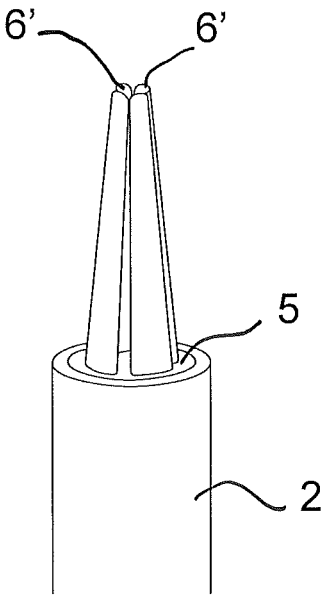
Figure 33:
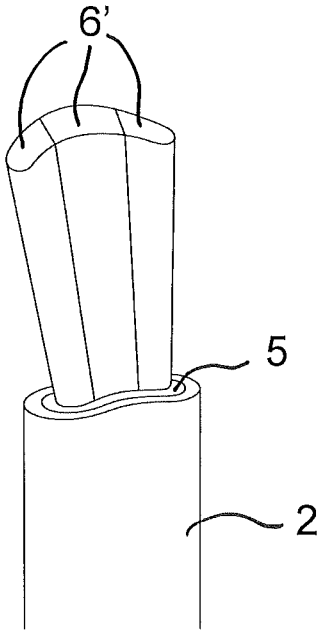
Figure 34A:
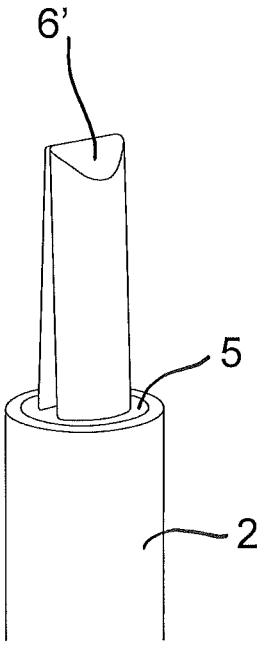
Figure 34B:
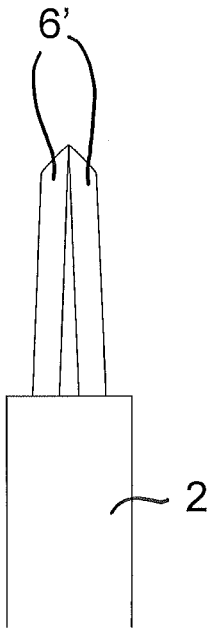
Figure 34C:
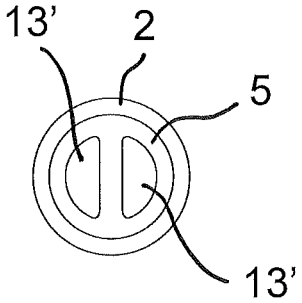
Figure 35A:
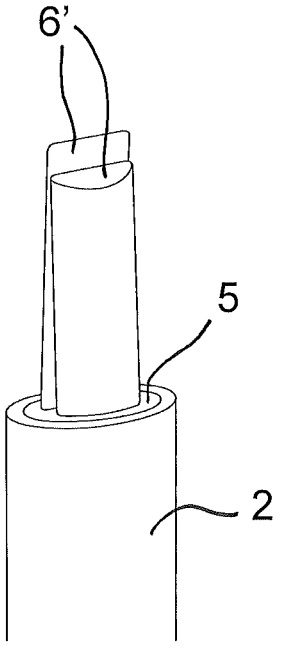
Figure 35B:
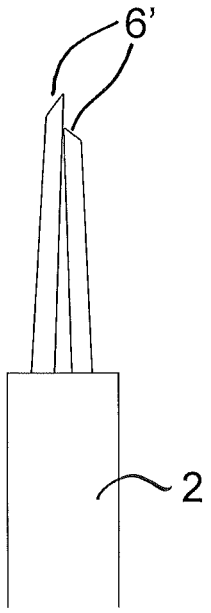
Figure 35C:
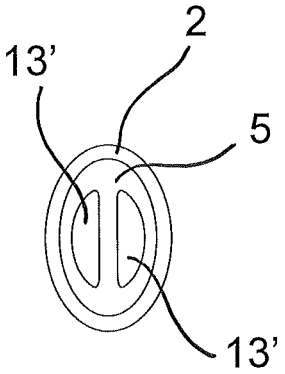
Figure 36A:
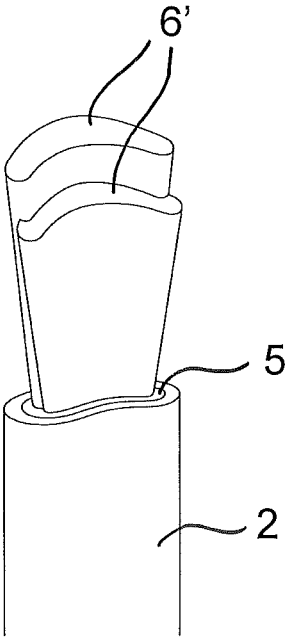
Figure 36B:
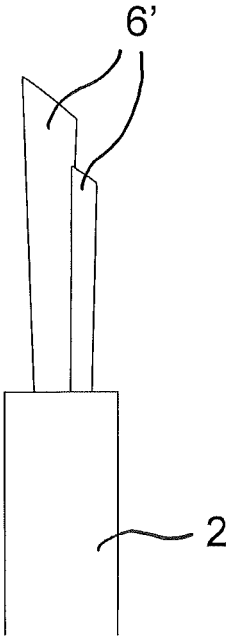
Figure 36C:
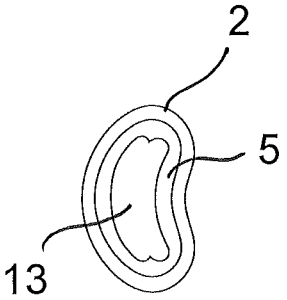
Figure 37:
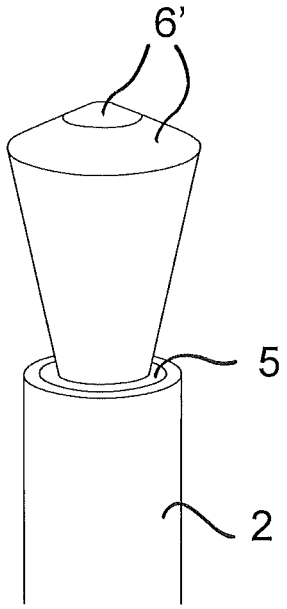
Figure 38:
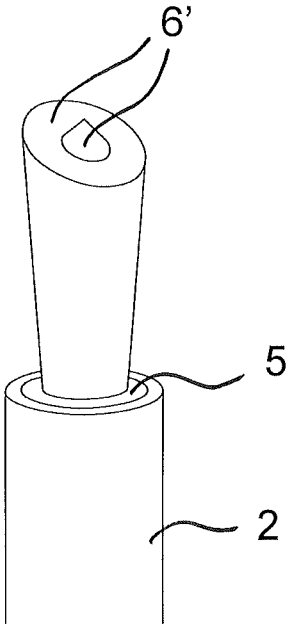
Figure 39:
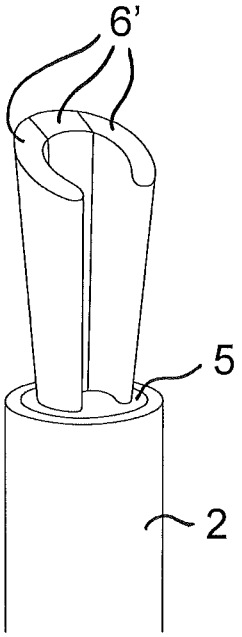
Figure 40:
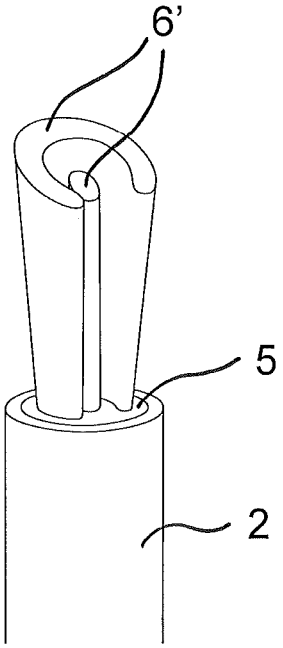
Figure 41:
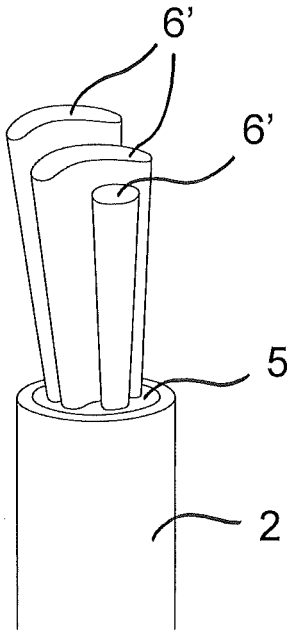
Figure 42:
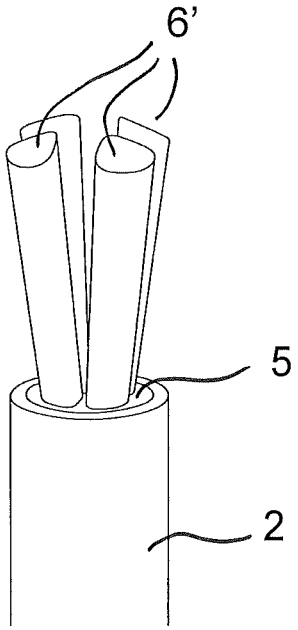
Figure 43:
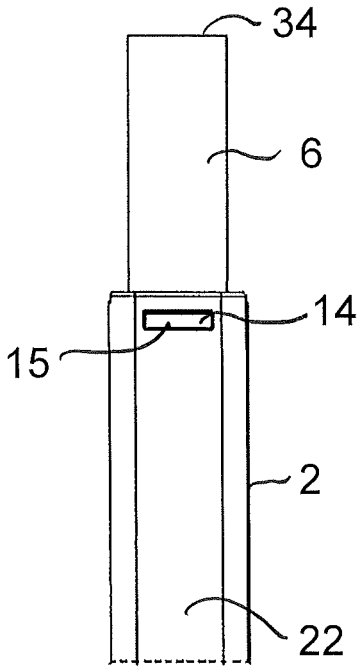
FIG. 43 illustrates a rectangular bristle field comprising bristle elements 6 with a flat end portion 34.
Figure 44:
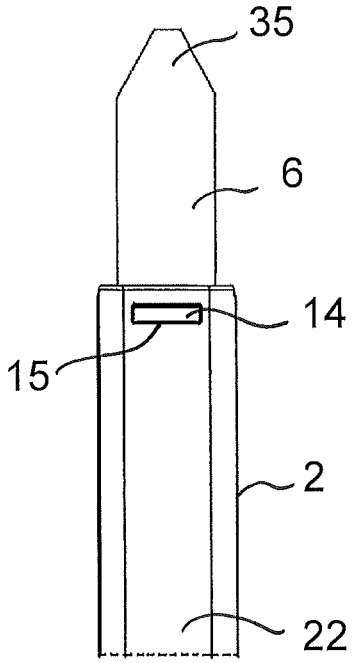
FIG. 44 shows a substantially rectangular bristle field comprising bristle elements 6 with an end portion 35 in the form of a truncated cone.
Figure 45:
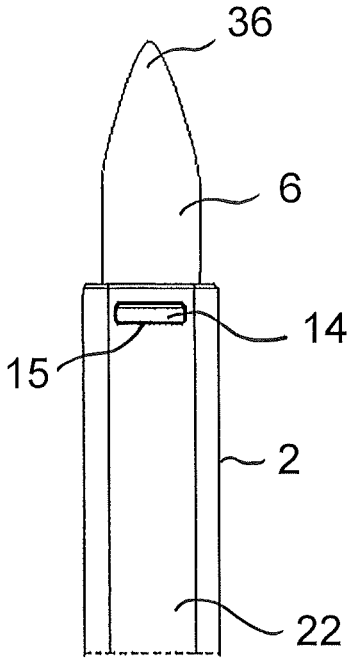
FIG. 45 depicts a bristle field comprising bristle elements 6 with a cone-shaped end portion 36.
Figure 46:
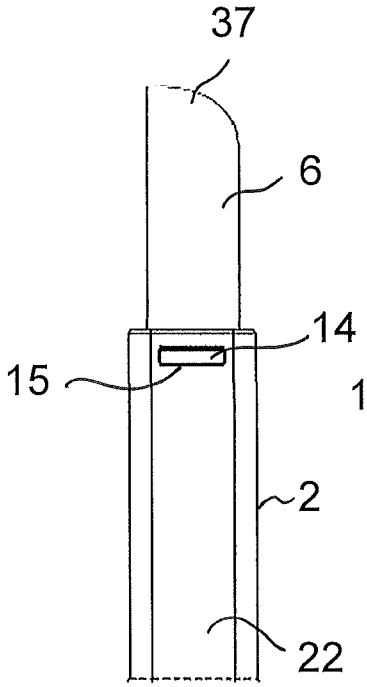
FIG. 46 shows a substantially rectangular bristle field comprising bristle elements 6 with an end portion 37 having a rounded corner on one side.
Figure 47:
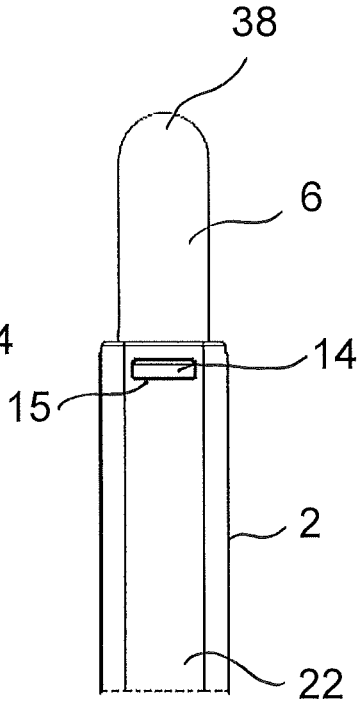
FIG. 47 shows a substantially rectangular bristle field comprising bristle elements 6 with a (fully) rounded-off end portion 38.
Figure 48:
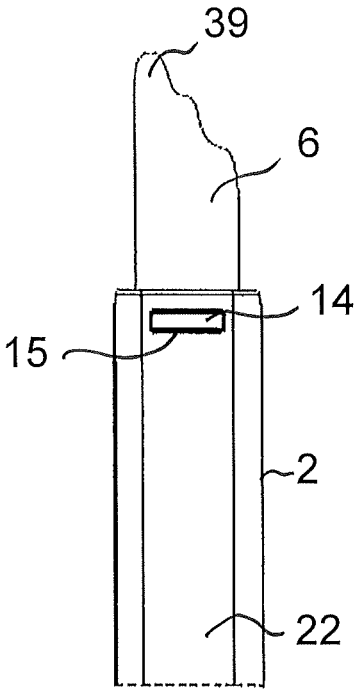
FIG. 48 depicts a bristle field comprising bristle elements 6 with an end portion 39 in form of a wavy chamfer.
Figure 49:
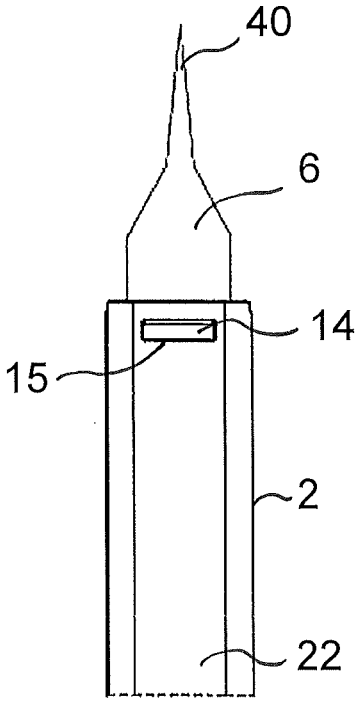
FIG. 49 illustrates a bristle field comprising bristle elements 6 with a mandrel-shaped end portion 40.
Figure 50:
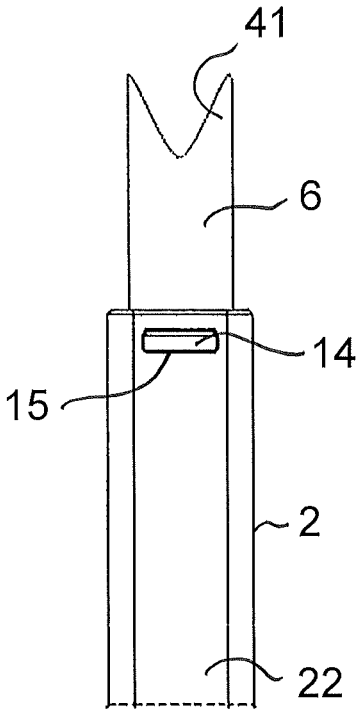
FIG. 50 depicts a bristle field comprising bristle elements 6 with a notched end portion 41.
Figure 51:
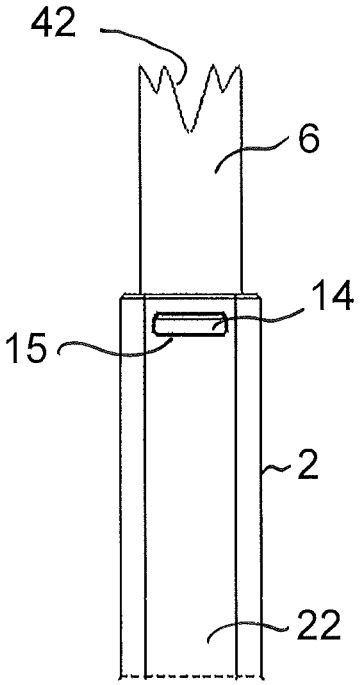
FIG. 51 shows a bristle field comprising bristle elements 6 with a furcated end portion 42 (i.e. one lager notch in the center of the end portion with one smaller notch on each side).
Figure 52:
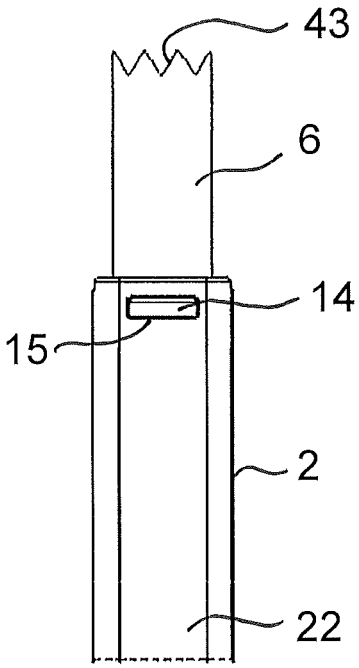
FIG. 52 depicts a bristle field comprising bristle elements 6 with a serrated or toothed end portion 43.
Figure 65:
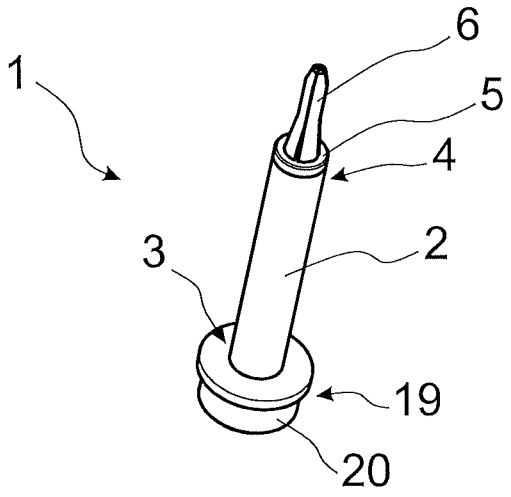
Figure 66:
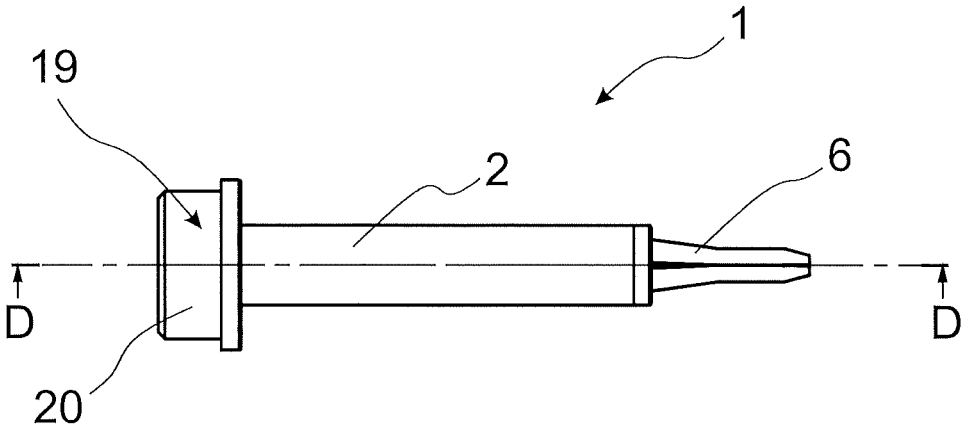
Figure 67:
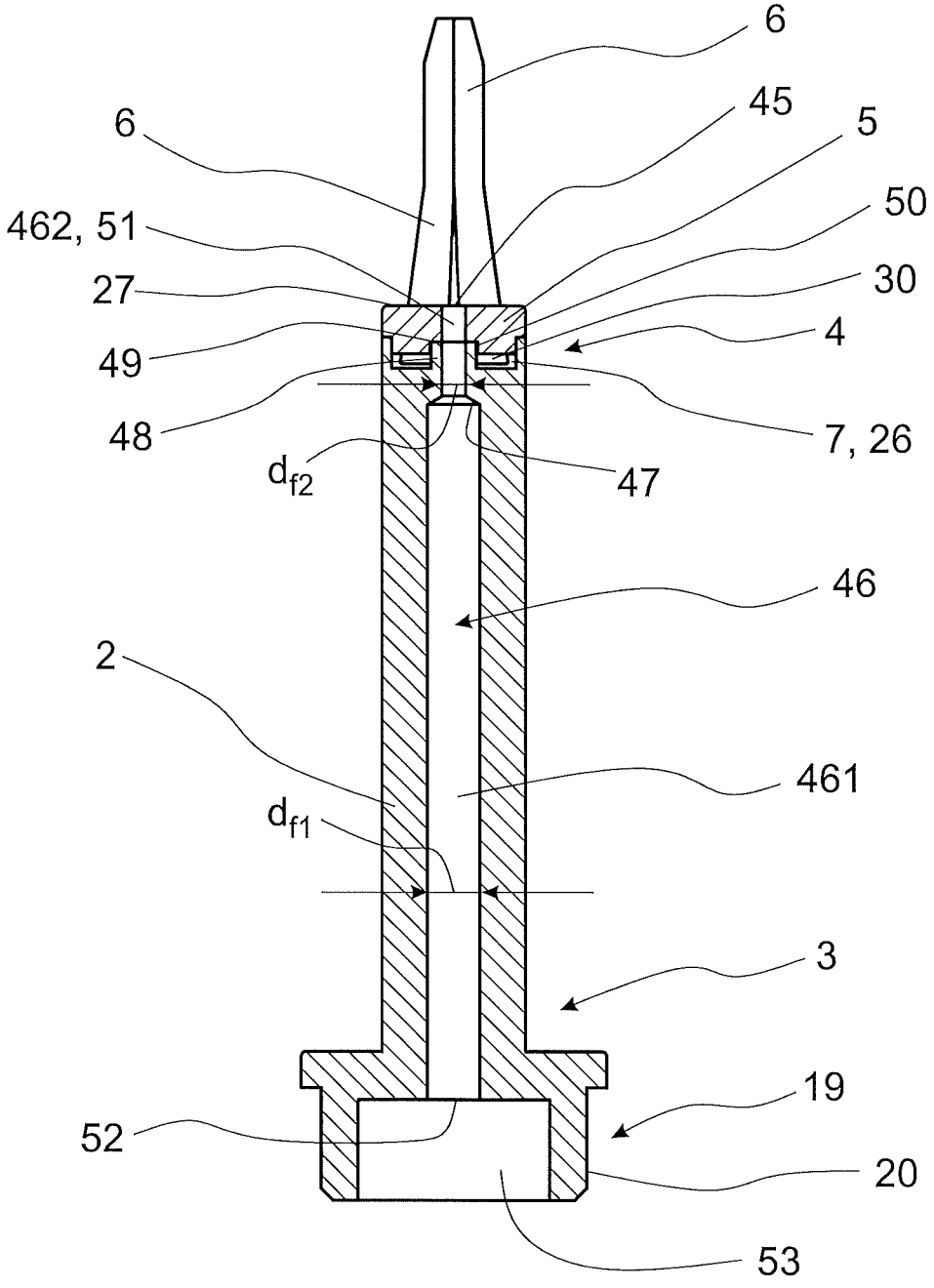

FIGS. 65 to 67 illustrate a further inventive applicator device 1. The bristled carrier element 5 has been introduced into the shaft 2. The shaft 2 has a circular round cross section. The bristle elements 6 respectively the bristle field protrudes from the distal end 4 of the shaft 2. At the proximal end 3 of the shaft 2, the base element 19 with fastening means 20 is arranged. Between the bristle elements 6, a fluid outlet 45 is arranged. As the cross section view of FIG. 67 taken according to line D-D in FIG. 66 shows, the fluid outlet 45 is arranged at a distal end of a fluid channel 46. The fluid channel 46 establishes a fluid connection from a tank or fluid reservoir of an applicator medium (not shown) which is connected to the base element 19, to the fluid outlet 45. The fluid respectively applicator medium can flow from the tank or fluid reservoir (not shown) through the fluid channel 46 to the fluid outlet 45. The fluid outlet 45 is arranged between the bristle elements respectively bristle bundles 6 so the fluid can directly flow to the bristle elements 6 which form the application elements. The bristle elements respectively bristle bundles 6 are arranged in the form of a tent similar to the arrangement shown in FIG. 32.

The fluid channel 46 comprises, as shown, two fluid channel parts 461, 462. A first fluid channel part 461 is formed within the shaft 2. The first fluid channel part 461 respectively the section of the fluid channel 46 with the first fluid channel part 461 has a diameter $d_{f1}$ at the proximal end 3 of the shaft 2 which is larger than a diameter $d_{f2}$ of the first fluid channel part 461 at the distal end 4 of the shaft 2. There is a step 47 in the first fluid channel part 461 which is located in the third of the first fluid channel part 461 next to the distal end 4 of the shaft 2. The first fluid channel part 461 communicates at the distal end 4 of the shaft 2 with a second fluid channel part 462 of the fluid channel 46 which is formed as a through-hole 51 in the carrier element 5. At the distal end 4 of the shaft 2, a tube-like extension 48 is formed in the depression 26 of the receiving opening 7. The first fluid channel part 461 extends with its smaller diameter section into the tube-like extension 48. The first fluid channel part 461 is arranged centrally within the shaft 2. The inner wall of the first fluid channel part 461 and the inner wall of the second fluid channel part 462 are flush at an edge 49 of the tube-like extension 48 which forms the interface between the first fluid channel part 461 and the second fluid channel part 462. The second fluid channel part is arranged centrally within the carrier element 5. The carrier element 5 comprises a recess 50 which is dimensioned to receive the tube-like extension 48. The melt carpets 30 of the bristle elements 6 are arranged next to the recess 50 such that the melt carpets 30 do not interfere the introduction of the tube-like extension 48 into the recess 50. In other embodiments, the carrier element 5 may comprise a tube-like extension with a section of the second fluid channel part extending into the tube-like extension and the shaft 2 may comprise a recess dimensioned to receive the tube-like extension. In other embodiments, the shaft or the carrier element may not comprise a recess to receive the tube-like extension and the tube-like extension of the carrier element or of the shaft may abut on a flat abutting face of the shaft or of the carrier element, respectively. The length of the tube-like extension 48 is set in a way that the fluid channel 46 extends without a leakage to the carrier element 5. The fluid channel 46 is lead through the carrier element 5 by the through hole 51, whereby the fluid outlet 45 is formed at the upper side 27 of the carrier element 5. At the proximal end of the shaft 2, the fluid channel 46 or fluid inlet 52 ends into an inner side 53 of the base element 19 which forms a recessed inner side of the thread 20. FIG. 67 shows that the fluid outlet 45 is arranged between the bristle elements 6. Further, it can be seen that the passage of the fluid channel 46 from the shaft 2 to the carrier element 5 is established as the two shaft 2 and the carrier element 5 are pressed against each other and fit closely. Thus, the fluid channel 46 allows an applicator medium to flow from a tank connected to the base element 19 through the shaft 2 and the carrier element 5 to the bristle elements 6.

LIST OF REFERENCE NUMBERS

1 applicator device
2 shaft
3 proximal end shaft
4 distal end shaft
5 carrier element
6 bristle elements (first type)
6*a* bristle elements (second type)
6*b* bristle elements (third type)
6' bristle bundles
7 receiving opening
8 upper edge of shaft
9 recess in upper edge (notch)
10 lateral protrusions of carrier element (and connection webs in the unseparated state)
11 free end of bristle element
12 mounting end of bristle element
13 central opening of carrier element
13' recesses/openings of carrier element
14 fastening means carrier element
15 recess in distal shaft end (slot/through-hole)
17 grid-like structure
18 frame
19 base element
191 recess
20 thread
21 support collar
22 wide side of shaft
23 narrow side of shaft
25 recess in frame
26 depression in distal shaft end
27 upper side carrier element
28 rear side carrier element
29 bristle field with rounded edge
30 melt carpet
31 bottom of depression
32 predetermined breaking point
33 side walls carrier element
34 bristle field with rectangular shape
35 bristle field with truncated cone
36 bristle field with cone-shaped tip
37 bristle field with rounded edge
38 bristle field with rounded corner
39 bristle field with wavy chamfer
40 bristle field with mandrel-shaped tip
41 bristle field with notched tip
42 bristle field with furcated tip
43 bristle field with serrated tip
44 bristle field with rounded tip
45 fluid outlet
46 fluid channel
461 first fluid channel part
462 second fluid channel part
47 step
48 tube-like extension
49 edge
50 recess
51 through hole
52 fluid inlet
53 inner side
X longitudinal axis
$c_{co}$ conicity central opening
$c_d$ conicity depression
$c_{rs}$ conicity recess distal shaft end
$d_s$ depth shaft
$d_d$ total depth depression
$d_{d1}$ first depth depression
$d_{d2}$ second depth depression
$d_{f1}$ large diameter of the first fluid channel part
$d_{f2}$ small diameter of the first fluid channel part
$d_{ru}$ depth recess upper edge
$h_{fc}$ height fastening means carrier element
$h_{rs}$ height recess in distal shaft end
$l_c$ length carrier element
$l_{co}$ length central opening
$l_d$ length depression
$l_{fc}$ length fastening means carrier element
$l_{gs}$ length grid-like structure
$l_{rs}$ length recess in distal shaft end
$l_s$ length shaft
$w_c$ width carrier element
$w_{co}$ width central opening
$w_d$ width depression
$w_{gs}$ width grid-like structure
$w_{ru}$ width recess upper edge
$w_s$ width shaft
$w_{sc}$ width support collar
$t_c$ thickness carrier element
$t_{mc}$ thickness melt carpet
$t_{pc}$ thickness protrusion carrier element
$t_{ws}$ thickness wall shaft
$t_{wc}$ thickness wall carrier element

The invention claimed is:

1. An applicator device for cosmetic and/or hygiene applications, comprising a shaft that is elongate with a longitudinal axis and extends between a proximal end and a distal end, and includes a receiving opening at the distal end that opens in a direction of the longitudinal axis;

a carrier element comprising at least one central opening that is a through hole;

bristle elements are arranged at the carrier element in an anchor-free manner and extend through the at least one central opening, wherein the carrier element is in the receiving opening and extends into the receiving opening along the longitudinal axis, the carrier element is connected to the shaft, the carrier element forms a base with a closed outer contour which serves as a connection to the shaft, the carrier element carrying the bristle elements is fully introduced in the receiving opening to be flush with an upper edge at the distal end of the shaft, at least one recess interrupts the upper edge at the distal end of the shaft, the at least one recess is configured to receive lateral protrusions of the carrier element, and the carrier element comprises at least one hook-like or tongue-like element which connects with a recess or through-hole in the shaft at a longitudinal side of the distal end of the shaft in an area of the receiving opening.

2. The applicator device according to claim 1, wherein the receiving opening is in a shape of a blind-hole-like depression which comprises a rectangular, an elliptical, a circular, a polygonal, or a regular polygonal form.

3. The applicator device according to claim 1, wherein the carrier element and the shaft are connected to one another by means of positive fit and/or force fit and/or material fit, and wherein the connection is realized in the form of a snap connection, by ultrasonic welding, by injection molding, by bonding and/or crimping, and/or by heat exposure.

4. The applicator device according to claim 1, wherein the carrier element and the shaft are inseparably connected such that the carrier element and the shaft cannot be disassembled without being destroyed.

5. The applicator device according to claim 1, wherein the bristle elements consist of a free end and a mounting end, wherein the mounting ends of the bristle elements are connected to the carrier element by way of positive fit and/or force fit and/or material fit, and wherein the connection between the mounting ends of the bristle elements and the carrier element is realized by ultrasonic welding, injection molding, bonding and/or crimping, and/or heat exposure.

6. The applicator device according to claim 1, wherein the carrier element comprises multiple through holes and/or blind holes.

7. The applicator device according to claim 1, wherein the carrier element is substantially ring-shaped.

8. The applicator device according to claim 1, wherein the at least one hook-like or tongue-like element is arranged at a longitudinal side of the carrier element, or wherein the at least one hook-like or tongue-like element comprises a length between 1 mm and 6 mm and a height between 0.1 mm and 0.6 mm.

9. The applicator device according to claim 1, wherein the at least one recess comprises a width between 0.4 mm and 2 mm and a depth between 0.3 mm and 1.2 mm.

10. The applicator device according to claim 1, wherein in a mounted state a snap connection is formed between the at least one hook-like or tongue-like element and the recess in the distal end of the shaft.

11. The applicator device according to claim 1, wherein at the proximal end of the shaft there is at least one fastening means for realizing a connection with a grip element, and wherein the at least one fastening means at the proximal end of the shaft is in the form of a thread or in the form of latches.

12. The applicator device according to claim 1, wherein the applicator device is a nail polish brush, a lip gloss brush, a mascara brush, an interdental cleaner, or a single tuft brush.

13. The applicator device according to claim 1, wherein the bristle elements are at least one bristle bundle, and wherein the at least one bristle bundle comprises one or more different types of bristle elements.

14. The applicator device according to claim 13, wherein the at least one bristle bundle comprises one-component bristle elements or multi-component bristle elements or a mixture thereof, wherein the multi-component bristle elements each comprise: (a) a core with one or more resins and one outer layer with one or more resins wherein the outer layer surrounds the core or (b) two or more components embodied to be linked with each other.

15. The applicator device according to claim 13, wherein different regions of the applicator device comprise at least one bristle bundle with different properties, a different composition, and/or a different shape in one and/or more sections of the at least one bristle bundle, wherein the different composition is present in one or more portions of the bristle elements and/or in one or more of the bristle elements and/or in one or more sections of the at least one bristle bundle and/or in different bristle bundles comprised in the applicator device, and wherein the different shape is present in one or more portions of the bristle elements and/or in one or more of the bristle elements and/or in one or more sections of the at least one bristle bundle and/or in different bristle bundles comprised in the applicator device.

16. The applicator device according to claim 13, wherein the bristle elements comprise at least one thermoplastic resin.

17. The applicator device according to claim 16, wherein the at least one thermoplastic resin is a resin selected from the group of polyolefines, polyamides, polyesters, polycarbonates, polyoxymethylenes, polyether ketones, polysulfones, polyether sulfides, thermoplastic polyether imides, and thermoplastic polyimides.

18. The applicator device according to claim 16, wherein the at least one bristle bundle further comprises at least one elastomer resin.

19. The applicator device according to claim 16, wherein the at least one bristle bundle comprises bristle elements having a diameter from 0.0254 mm to 0.508 mm.

20. A method for producing the applicator device according to claim 1, the method comprising:

(a) injection molding the shaft, wherein the distal end of the shaft includes the receiving opening;

(b) injection molding the carrier element and simultaneously or subsequently providing the carrier element with the bristle elements in an anchor-free manner; and (c) mounting the carrier element containing the bristle elements in the receiving opening of the shaft.

21. A package comprising a reservoir and the applicator device according to claim 1.

22. The applicator device according to claim 1, wherein the bristle elements are connected to the carrier element and melted ends of the bristle elements protrude from a rear side of the carrier element.

23. The applicator device according to claim 1, wherein the carrier element is connected to the shaft in a non-moving manner.

24. The applicator device according to claim 1, wherein melted ends of the bristle elements are fixed between the carrier element and the shaft.

* * * * *